US009734801B2

(12) United States Patent
Noh et al.

(10) Patent No.: US 9,734,801 B2
(45) Date of Patent: Aug. 15, 2017

(54) DISPLAY DEVICE AND METHOD FOR DISPLAYING IMAGE USING THE SAME

(71) Applicant: Samsung Display Co., Ltd., Yongin-si (KR)

(72) Inventors: Jin Woo Noh, Yongin-si (KR); Byung Ki Chun, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/011,776

(22) Filed: Feb. 1, 2016

(65) Prior Publication Data

US 2016/0343354 A1 Nov. 24, 2016

(30) Foreign Application Priority Data

May 22, 2015 (KR) ..... 10-2015-0072135

(51) Int. Cl.

| | |
|---|---|
| ***G09G 5/38*** | (2006.01) |
| ***G09G 3/20*** | (2006.01) |
| ***G09G 5/373*** | (2006.01) |

(52) U.S. Cl.

CPC ..... *G09G 5/38* (2013.01); *G09G 3/20* (2013.01); *G09G 5/373* (2013.01); *G09G 2320/0285* (2013.01); *G09G 2320/041* (2013.01); *G09G 2320/046* (2013.01); *G09G 2340/045* (2013.01); *G09G 2340/0464* (2013.01); *G09G 2340/0471* (2013.01); *G09G 2340/0478* (2013.01); *G09G 2380/02* (2013.01)

(58) Field of Classification Search

None

See application file for complete search history.

(56) References Cited

U.S. PATENT DOCUMENTS

| | | | | |
|---|---|---|---|---|
| 8,873,101 | B2 | 10/2014 | Tamura | |
| 2012/0236040 | A1* | 9/2012 | Eom | G09G 3/007 345/681 |
| 2013/0215041 | A1 | 8/2013 | Kim et al. | |
| 2014/0300557 | A1 | 10/2014 | Cho et al. | |
| 2015/0138041 | A1* | 5/2015 | Hirakata | G06F 3/1446 345/1.3 |

(Continued)

FOREIGN PATENT DOCUMENTS

| | | | |
|---|---|---|---|
| EP | 1847978 | A2 | 10/2007 |
| EP | 2500896 | A1 | 9/2012 |

(Continued)

OTHER PUBLICATIONS

Partial European Search Report for Application No. 16168624.1 dated Aug. 31, 2016.

(Continued)

*Primary Examiner* — Nicholas Lee

(74) *Attorney, Agent, or Firm* — Cantor Colburn LLP

(57) ABSTRACT

A display device includes a display panel including a first display area displaying a first image and a second display area adjacent to the first display area and displaying a second image and an image corrector generating an image shifted by correcting the first image and the second image where the image corrector may correct the first image and the second image such that the first image is shifted only in the first display area and the second image is shifted only in the second display area.

20 Claims, 15 Drawing Sheets

(56) References Cited

U.S. PATENT DOCUMENTS

| | | | |
|---|---|---|---|
| 2016/0179269 | A1 | 6/2016 | Chun et al. |
| 2016/0320916 | A1 | 11/2016 | Chun et al. |
| 2016/0321974 | A1 | 11/2016 | Chun et al. |
| 2016/0329008 | A1 | 11/2016 | Chun et al. |

FOREIGN PATENT DOCUMENTS

| | | | |
|---|---|---|---|
| JP | 2012121165 | | 6/2012 |
| KR | 1020040026059 | | 3/2004 |
| KR | 1020050048300 | | 5/2005 |
| KR | 1020070048852 | | 5/2007 |
| KR | 1020140120470 | | 10/2014 |
| KR | 1020160129983 | A | 11/2016 |
| KR | 1020160130027 | A | 11/2016 |
| KR | 1020160132170 | A | 11/2016 |

OTHER PUBLICATIONS

Partial European Search Report for Application No. 16170870.6 dated Sep. 23, 2016.

* cited by examiner

LUT

| FI | [(SDx)SQx , (SDy)SQy] |
|---|---|
| 10 | [(−)1 , 0] |
| 20 | [(−)1 , (+)1] |
| 30 | [ 0 , (+)1] |
| 40 | [(+)1 , (+)1] |
| 50 | [(+)1 , 0 ] |
| ⋮ | ⋮ |

DISPLAY DEVICE AND METHOD FOR DISPLAYING IMAGE USING THE SAME

This application claims priority to Korean Patent Application No. 10-2015-0072135, filed on May 22, 2015, and all the benefits accruing therefrom under 35 U.S.C. §119, the content of which in its entirety is incorporated herein by reference.

BACKGROUND

1. Field

Exemplary embodiments relate to a display device and a method for displaying image using the same.

2. Description of the Related Art

Recently, various types of display devices such as organic light emitting display devices, liquid crystal display devices, plasma display devices and the like are widely used.

Since the display devices continuously output certain images or letters for a long time with a long operating time, the display devices may have performance deterioration because certain pixels may be subject to heat deterioration.

To overcome this limitation, an image may be moved on the display panel for a set cycle, or pixel shifting may be used. When an image is moved for a set cycle on the display panel and is displayed, same data may be prevented from being output for a long time from a certain pixel, and therefore, heat deterioration of the certain pixel may be avoided.

SUMMARY

Moving image and displaying the same uses a method for generating new image data by storing image data before moving and after moving the image. In order to generate new image data, image data before shifting and image data after the shifting must be separately stored in a memory.

Also, since new image data is generated by combining the image data before the move and the image data after the move, a problem arises in to which afterimage occurrence is not fundamentally resolved.

Exemplary embodiments are related to a display device and a method for displaying image using the same which reconfigures image data without additional memory, thereby minimizing thermal deterioration of certain pixel and providing pixel shifting technology capable of effectively preventing afterimage.

In an exemplary embodiment, a display device may include a display panel including a first display area displaying a first image and a second display area adjacent to the first display area and displaying a second image and an image corrector generating an image shifted by correcting the first image and the second image. The image corrector may correct the first image and the second image such that the first image is shifted only in the first display area and the second image is shifted only in the second display area.

In an exemplary embodiment, the first display area may be a flat display area.

In an exemplary embodiment, the second display area may be a bent display area positioned on one side of the first display area.

In an exemplary embodiment, the display panel may further include a third display area positioned in a direction facing the second display area. The third display area may be a bent display area.

In an exemplary embodiment, the display panel further include a fourth display area positioned in a direction that does not face the second display area and a fifth display area positioned in a direction facing the fourth display area.

In an exemplary embodiment, the image corrector may include a frame data counter for receiving a frame data and calculating an input number of the frame data, a shift determiner for determining shift direction of the first image and the second image and shift amount of the first image and the second image according to a pre-stored look-up table, an area determiner for dividing the first display area and the second display area into a plurality of areas, determining a first area among the plurality of areas as a reduction area depending on determined shift amount and determining a second area among the plurality of areas as an enlargement area and an image data generator for generating reduced image corresponding to determined shift amount and setting the reduced image to an image displayed in the first area.

In an exemplary embodiment, the shift determiner may determine the look-up table corresponding to the input number and determine the shift direction and the shift amount using a value included in the look-up table.

In an exemplary embodiment, the shift determiner may include an x-axis shift determiner for determining an x-axis shift direction and an x-axis shift amount of the first image and the second image and a y-axis shift determiner for determining a y-axis shift direction and a y-axis shift amount of the first image and the second image.

In an exemplary embodiment, the x-axis shift determiner may determine the x-axis shift amount such that the first image and the second image shift along x-axis direction in smaller units than minute image displayed in one pixel.

In an exemplary embodiment, the y-axis shift determiner may determine the y-axis shift amount such that the first image and the second image shift along y-axis direction in smaller units than minute image displayed in one pixel.

In an exemplary embodiment, the shift determiner may determine the y-axis shift direction and the y-axis shift amount of the first image and the second image after determining the x-axis shift direction and the x-axis shift amount of the first image and the second image.

In an exemplary embodiment, the shift determiner may determine shift direction of the first image and shift direction of the second image as same directions.

In an exemplary embodiment, the area determiner may determine a third area positioned between the first area and the second area. An image displayed in the third area may shift from the enlargement area in a direction to where the reduction area is located.

In an exemplary embodiment, the image data generator may generate an enlarged image to correspond to determined shift amount and set the enlarged image to an image displayed in the second display area.

In an exemplary embodiment, the first image and the second image may shift from the enlargement area in a direction to the reduction area.

In an exemplary embodiment, the first image and the second image prior to shifting have size same as the first image and the second image after shifting.

In another exemplary embodiment, a method for displaying image by a display device including a display panel including a first display area displaying a first image and a second display area adjacent to the first display area and displaying a second image and an image corrector which generates first and second images shifted on the display panel by correcting the first image and the second image, the method may include receiving a frame data including image data, by the image corrector, calculating an input number of the frame data and determining a look-up table corresponding to a result of the calculation, by the image corrector, determining shift direction and shift amount of the first image and the second image using the look-up table, by the image corrector, dividing the first display area and the second display area into a plurality of areas and, depending on the shift amount, determining a first area as a reduction area among the plurality of areas and determining a second area as an enlargement area, by the image corrector, setting reduced image to correspond to the shift amount to an image data displayed in the first area, by the image corrector and setting enlarged image to correspond to the shift amount to an image data displayed in the second area, by the image corrector. The second display area may be a bent display area positioned on one side of the first display area.

In an exemplary embodiment, the shift amount of the first image and the second image may be less than a size of minute image displayed in one pixel.

In an exemplary embodiment, the setting to the image displayed in the first area may generate the reduced image by reducing an image having a larger area than the first area to an area having a same size as that of the first area and set the reduced image to an image displayed in the first area, by the image corrector.

In an exemplary embodiment, the setting to the image displayed in the second area may generate the enlarged image by enlarging an image having a smaller area than the second area to an area having a same size as that of the second area and set the enlarged image to an image displayed in the second area, by the image corrector.

In an exemplary embodiment, according to a display device and a method for display an image using the same, by reconfiguring image data without separate memory, deterioration of certain pixel is minimized, and afterimage may be avoided more effectively.

BRIEF DESCRIPTION OF THE DRAWINGS

Exemplary embodiments will now be described more fully hereinafter with reference to the accompanying drawings, in which.

DETAILED DESCRIPTION

Figure 1:
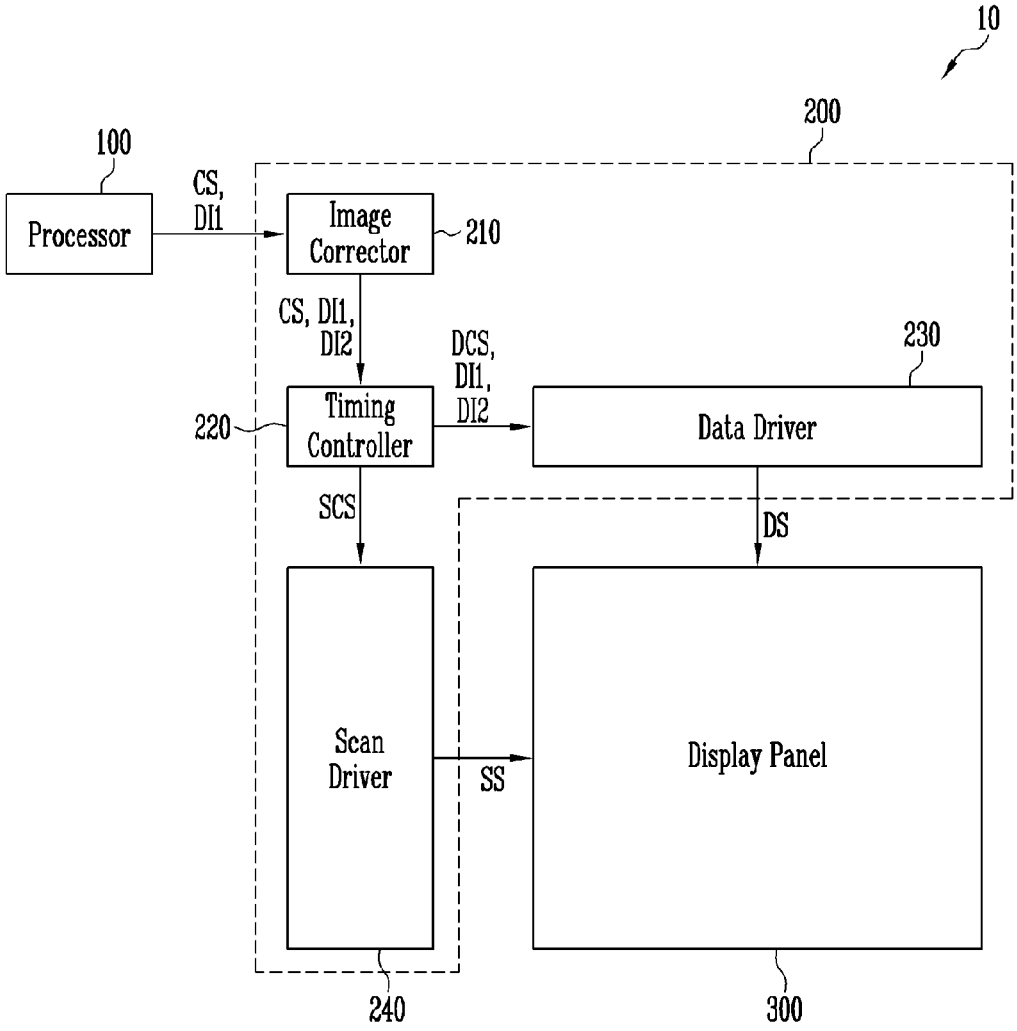
FIG. 1 is a schematic block diagram of an exemplary embodiment of a display device according to the invention.

In the following detailed description, only certain exemplary embodiments of the invention have been shown and described, simply by way of illustration. As those skilled in the art would realize, the described embodiments may be modified in various different ways, all without departing from the spirit or scope of the invention. Accordingly, the drawings and description are to be regarded as illustrative in nature and not restrictive. In addition, it will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section, a second element, component, region, layer or section could be termed a first element, component, region, layer or section, and so forth, without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a schematic block diagram of a display device according to an exemplary embodiment.

Referring to FIG. 1, a display device 10 according to an exemplary embodiment may include a processor 100, a display driver 200 and a display panel 300.

The processor 100 may supply a first image data DI1 and a control signal CS to the display driver 200.

In an exemplary embodiment, for example, but without limitation thereto, the processor 100 may be implemented with an integrated circuit ("IC"), an application processor ("AP"), a mobile AP or a processor capable of controlling operation of the display driver 200.

In an exemplary embodiment, for example, but without limitation thereto, a control signal may include a vertical synchronization signal, a horizontal synchronization signal, a data enable signal, a clock signal and the like.

The display driver 200 may include an image corrector 210, a timing controller 220, a scan driver 240 and a data driver 230.

The image corrector 210 may generate a second image data DI2 using a first image data DI1 and a control signal CS. Also, the image corrector 210 may transmit the first image data DI1, the second image data DI2 and the control signal CS to a timing controller 220. The second image data DI2 may refer to image data which is the first image data DI1 that is moved using pixel shifting.

In accordance with another exemplary embodiment, the image corrector 210 may supply the first image data DI1, the second image data DI2 and the control signal CS to the data driver 230.

In accordance with an exemplary embodiment, the image corrector 210 may be separated from the display driver 200.

In accordance with another exemplary embodiment, the image corrector 210 may be integrated with the timing controller 220. The timing controller 220 may convert the first image data DI1 into the second image data DI2.

The timing controller 220 may receive the first image data DI1, the second image data DI2 and the control signal CS from the image corrector 210.

The timing controller 220 may generate a timing control signal for controlling the scan driver 240 and the data driver 230 based on the control signal CS.

In an exemplary embodiment, for example, but without limitation thereto, the timing control signal may include a scan timing control signal SCS for controlling the scan driver 240 and a data timing control signal DCS for controlling the data driver 230. The timing controller 220 may supply the scan timing control signal SCS to the scan driver 240 and the data timing control signal DCS to the data driver 230.

The timing controller 220 may supply the first image data DI1 to the data driver 230 during a first period to display an initial image and supply the second image data DI2 to the data driver 230 during a second period to display a corrected image.

The data driver 230 may receive the data timing control signal DCS and the first and second image data DI1 and DI2 from the timing controller 220 and generate a data signal DS.

The data driver 230 may supply the generated data signal DS to data lines.

The data driver 230 may be electrically coupled to the data lines located at the display panel 300 through separate components.

In accordance with another exemplary embodiment, the data driver 230 may be directly mounted on the display panel 300.

The scan driver 240 may supply scan signals (also referred to as "gate signals") SS to scan lines (also referred to as "gate lines") in response to the scan timing control signal SCS. The scan driver 240 may be electrically coupled to the scan lines SS positioned in the display panel 300.

In accordance with another exemplary embodiment, the scan driver 240 may be directly mounted on the display panel 300.

When the scan signal SS is supplied to the scan lines, pixels of the display panel 300 which receive the data signal DS through the data lines may emit light having brightness corresponding to the data signal DS.

In an exemplary embodiment, for example, but without limitation thereto, when the timing controller 220 or the image corrector 210 supplies the first image data DI1, the data driver 230 may supply the data signal DS corresponding to the first image data DI1, thereby displaying the initial image.

Also, when the timing controller 220 or the image corrector 210 supplies the second image data DI2, the data driver 230 may supply the data signal DS corresponding to the second image data DI2 to pixels, thereby displaying the corrected image.

The data driver 230 may be separated from the scan driver 240.

The display panel 300 may include pixels displaying a preset image.

The display panel 300 may display an image in accordance with control of the display driver 200.

In an exemplary embodiment, for example, but without limitation thereto, the display panel 300 may include organic light emitting display panel, liquid crystal display panel, plasma display panel and so forth, but it is not limited thereto.

Figure 2:
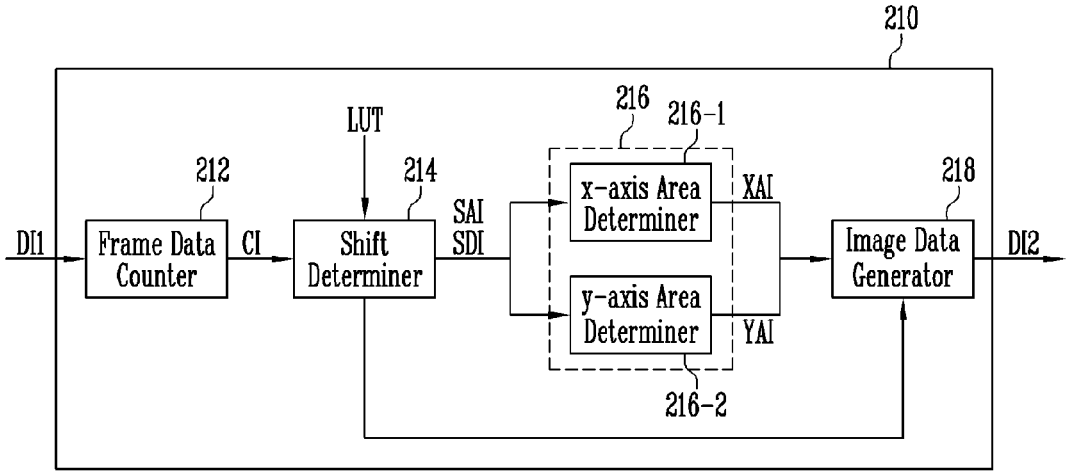
FIG. 2 is a schematic block diagram of an exemplary embodiment of an image corrector according to the invention.

FIG. 2 is a schematic block diagram of an image corrector according to an exemplary embodiment.

Referring to FIG. 2, the image corrector 210 may include a frame data counter 212, a shift determiner 214, an area determiner 216, and an image data generator 218.

The frame data counter 212 may generate frame information CI using the received frame data. The frame data counter 212 may use the control signal (e.g., vertical synchronization signal) which is supplied from the processor 100 to calculate to which frame data the first image data DI1, which is included in current frame data, belongs.

That is, the frame data counter 212 may generate the frame information CI by calculating how many times the frame data is input from the processor 100. The frame data counter 212 may supply the frame information CI to the shift determiner 214.

The shift determiner 214 may determine shift direction and shift amount of the image. In further detail, the shift determiner 214 may determine x-axis movement direction, y-axis movement direction, x-axis movement amount and y-axis movement amount.

The shift determiner 214 may generate image shift direction information SDI which includes information regarding movement direction of the determined image and generate shift amount information SAI which includes information regarding movement amount of the determined image.

In an exemplary embodiment, for example, but without limitation thereto, the shift determiner 214 may, by referring to the frame information CI transferred from the frame data counter 212, determine the x-axis shift direction, y-axis shift direction, x-axis shift amount and Y-axis shift amount corresponding to the frame information CI and generate the image shift direction information SDI and the image shift amount information SAI. The shift determiner 214 may use a look-up table LUT.

In an exemplary embodiment, for example, but without limitation thereto, the shift determiner 214 may determine y-axis shift direction and y-axis shift amount after determining x-axis shift direction and x-axis shift amount, or determine x-axis shift direction and x-axis shift amount after determining y-axis shift direction and y-axis shift amount.

In accordance with an exemplary embodiment, the shift determiner 214 may generate the look-up table LUT including information regarding shift direction and shift amount of image and determine shift direction and shift amount of the image using the generated look-up table LUT.

In accordance with another exemplary embodiment, the shift determiner 214 may determine the shift direction and shift amount of the image using the look-up table LUT which is transferred from an external device or which is already stored. The look-up table LUT will be described in detail with reference to FIGS. 12 and 13.

The area determiner 216 may include an x-axis area determiner 216-1 and a y-axis area determiner 216-2.

The x-axis area determiner 216-1 may determine the x-axis area using the shift direction information SDI and the shift amount information SAI and generate x-axis area information XAI with respect to the determined x-axis area. The x-axis area may include an x-axis reduced area, x-axis enlarged area and x-axis shift area.

The y-axis area determiner 216-2 may determine image shift direction information SDI and shift amount information SAI to determine y-axis area and generate y-axis area information YAI with respect to the determined y-axis area. The y-axis area may include y-axis reduced area, y-axis enlarged area and y-axis shift area.

The image data generator 218 may generate second image data DI2 to be displayed in each area using the x-axis area information XAI and the y-axis area information YAI.

Figure 3:
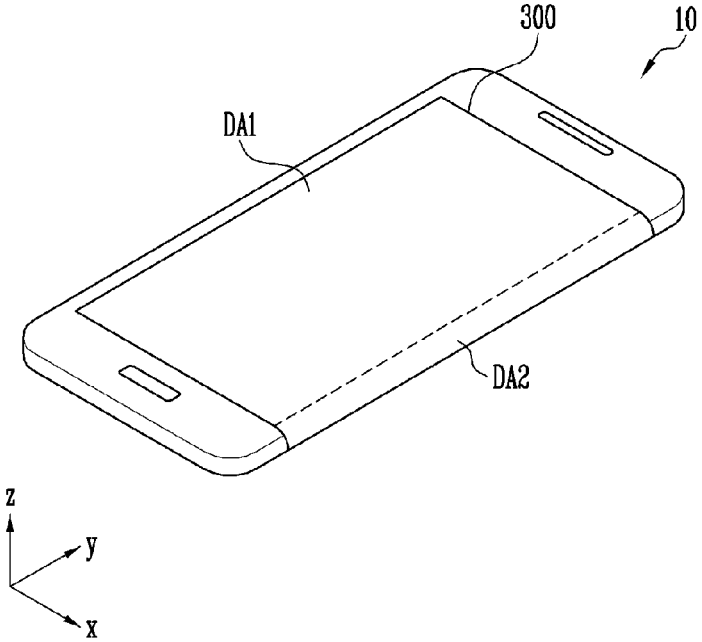
FIG. 3 is a perspective view of an exemplary embodiment of a display device according to the invention.
Figure 4:
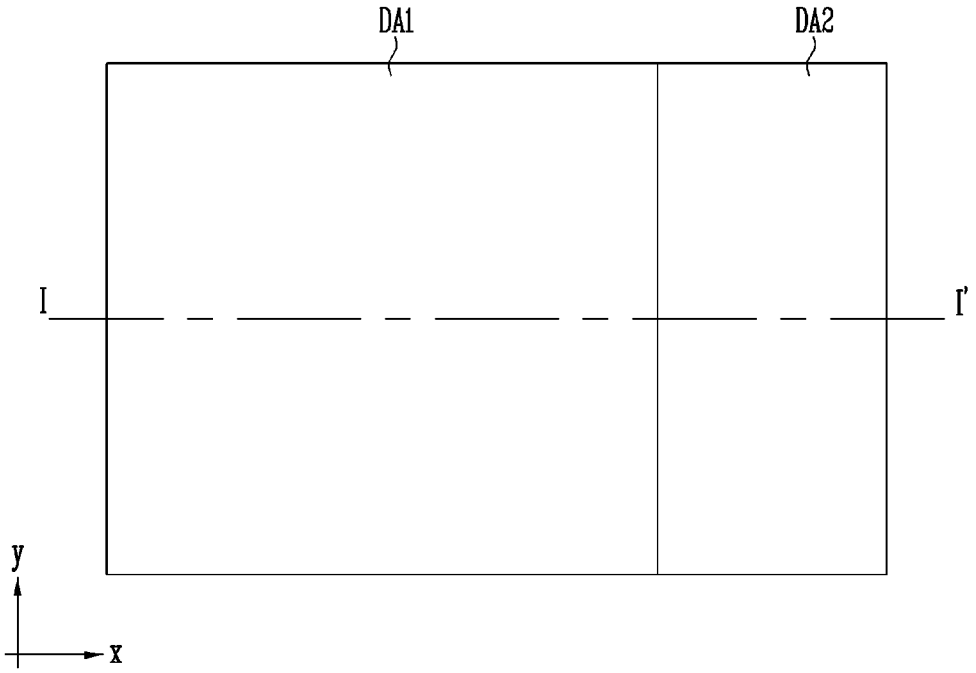
FIG. 4 is a plan view illustrating a display panel shown in FIG. 3.
Figure 5:
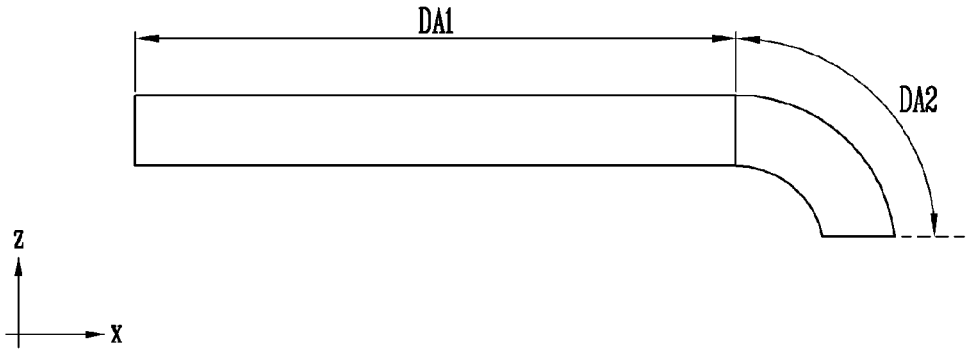
FIG. 5 is a cross-sectional view along I-I' in FIG. 3.

FIG. 3 is a perspective view of a display device according to an exemplary embodiment. FIG. 4 is a plan view illustrating a display panel shown in FIG. 3. FIG. 5 is a cross-sectional view along I-I' in FIG. 4.

For convenience in illustration, the surface where image is displayed is parallel to the surface formed by the x-axis and the y-axis, and the image is provided along the z-axis direction on the display device. Also, the z-axis direction is referred to as upper direction, and the direction opposite to the z-axis is referred to as lower direction. However, the direction in which each axis is directed is a relative concept and may be converted into a different direction. That is, in FIGS. 3 and 5, even though the z-axis direction is displayed as an upper direction on which an image is displayed, the z-axis direction (or the direction on which image is displayed) may not be an upper direction but may be a lower direction or may be converted into a side direction.

Referring to FIGS. 3 to 5, a display device 10 may include a first display area DA1 which is an area that appears on a front surface of a display panel 300 and a second display area DA2 that extends from one side of the first display area DA1 and has a bent shape on a side surface of the display device 10.

In an exemplary embodiment, for example, but without limitation thereto, the first display area DA1 may have a rectangular shape having two pairs of sides that are parallel to each other when viewed in a plane. Of the two pairs of sides, any one pair of sides may be longer than the other pair of sides. In an exemplary embodiment, although the first display area and the second display area are displayed in rectangular shape having a pair of long sides and a pair of short sides and the extending direction of the long sides is indicated as x-axis direction and the extending direction of the short sides is indicated as y-axis direction, it is not limited thereto.

The first display area DA1 may include a flat display area, and the second display area DA2 may include a bent display area having twisted or bent shape without any damage due to a substrate that is as thin as a paper and flexible.

That is, the display panel 300 which includes the first display area DA1 in a flat form and the second display area DA2 implemented as bent shape having an operable radius of curvature or less may be engaged to the display device 10.

In accordance with an exemplary embodiment, the second display area DA2 may have a flexible shape such as flexile display.

In an exemplary embodiment, for example, but without limitation thereto, the first display area DA1 may include a rigid area which does not have flexibility, and the second display area DA2 may include a flexible area having flexibility.

Here, the expression "has flexibility" or "does not have flexibility", and the term "flexible" or "rigid" are used relatively to show properties of a display panel. That is, the expression "does not have flexibility" and the term "rigid" may refer to not only the rigid state without any flexibility but also a state which has some degree of flexibility but which is less than what a flexible area may have.

The first display area DA1 may display a first image, and the second display area DA2 may display a second image. Here, shifting of the first image may be undertaken only in the first display area DA1, and shifting of the second image may be undertaken only in the second display area DA2.

Figure 6A:
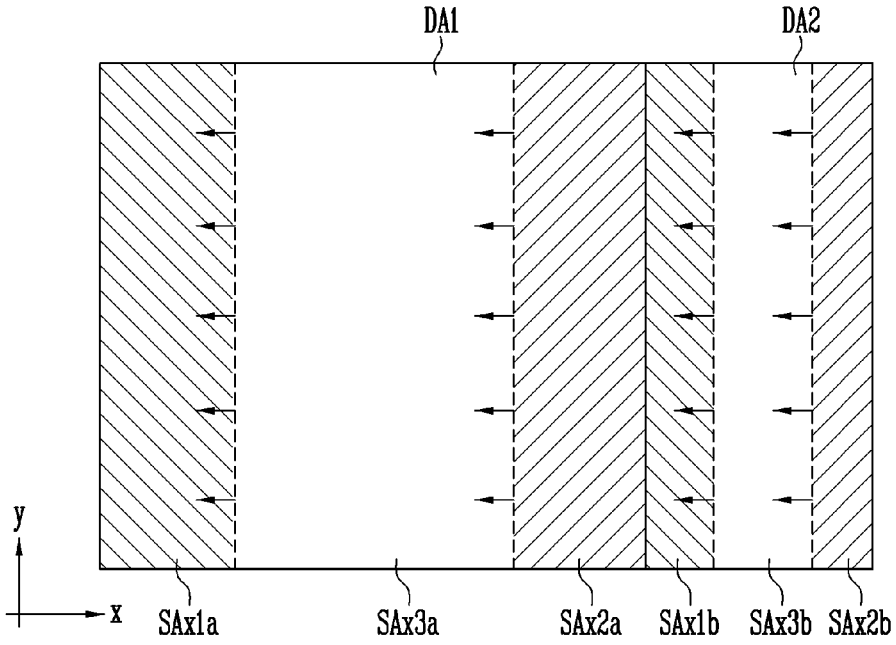
FIGS. 6A and 6B are conceptual diagrams for illustrating an exemplary embodiment of image movement on a display panel according to the invention.
Figure 6B:
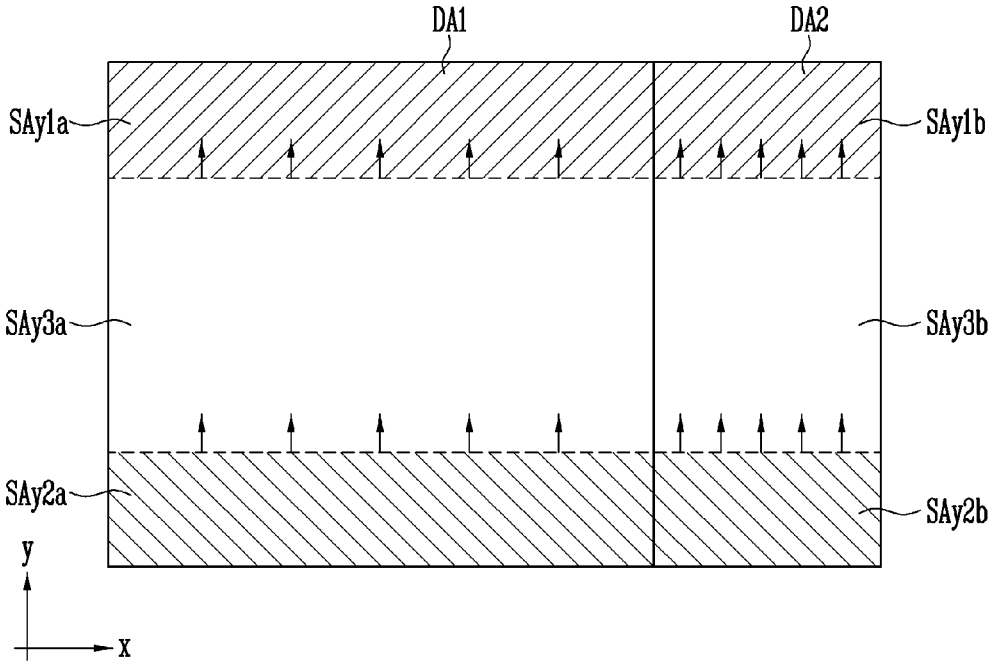
Figure 7:
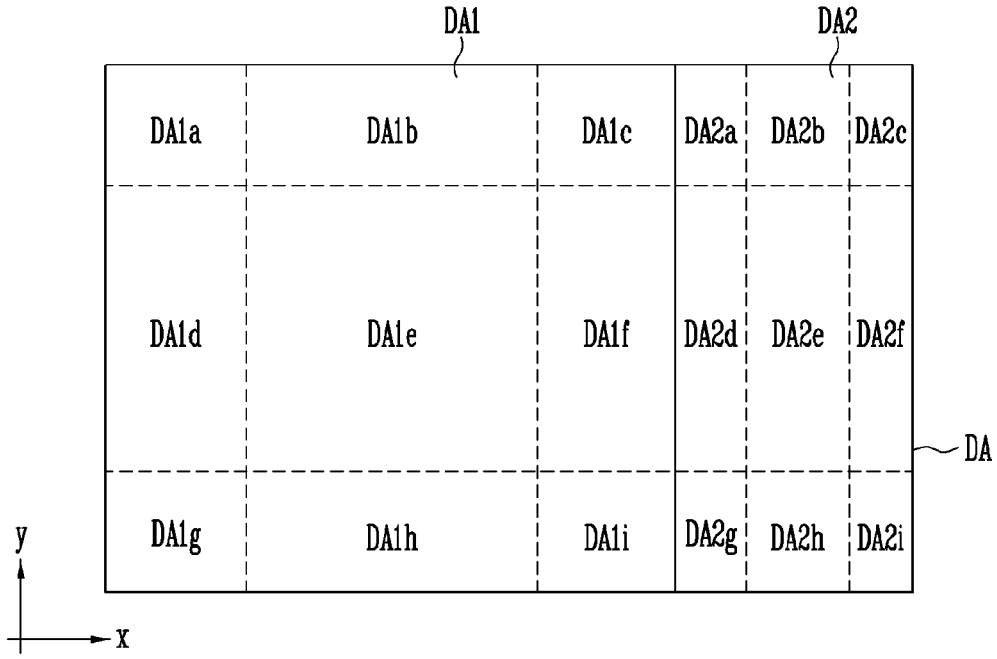
FIG. 7 is a conceptual diagram for illustrating display areas divided according to image movement of FIGS. 6A and 6B.

FIGS. 6A and 6B are conceptual diagrams for illustrating image movement on a display panel according to an exemplary embodiment. FIG. 7 is a conceptual diagram for illustrating display areas divided according to image movement of FIGS. 6A and 6B.

Referring to FIG. 6A, the display area may include a first display area DA1 which is divided into a first area SAx1*a*, a second area SAx2*a* and a third area SAx3*a*, and a second display area DA2 divided into a first area SAx1*b*, as second area SAx2*b* and a third area SAx3*b*.

In an exemplary embodiment, the first area SAx1*a* of the first display area and the first area SAx1*b* of the second display area are set to an x-axis reduced area, and the second area SAx2*a* of the first display area and the second area SAx2*b* of the second display area are set to the x-axis enlarged area. However, the first area SAx1*a* of the first display area and the first area SAx1*b* of the second area may be set to the x-axis enlarged area and the second area SAx2*a* of the first display area and the second area SAx2*b* of the second area may be set to the x-axis reduced area.

Also, the third area SAx3*a* of the first display area and the third area SAx3*b* of the second display area may be set to the x-axis shift area.

The image corrector 210 may reduce initial image displayed in the x-axis reduced area, enlarge the initial image displayed in the x-axis enlarged area, and shift the initial image displayed in the x-axis shift area The x-axis shift area refers to an image that is not reduced or enlarged.

The corrected image generated by the image corrector 210 may be displayed by moving a certain amount in a certain direction compared to the initial image.

Here, the first image displayed in the first display area DA1 and the second image displayed in the second image display DA2 may move along the same x-axis direction.

In an exemplary embodiment, for example, but without limitation thereto, the first image and the second image may be moved simultaneously along the negative x-axis direction or may be moved simultaneously along the positive x-axis direction. However, the invention is not limited thereto, and when the first image moves along the negative x-axis direction, the second image may move along the positive x-axis direction.

In accordance with an exemplary embodiment, the x-axis shift amount of the first image and the x-axis shift amount of the second image may be the same.

In accordance with another exemplary embodiment, the x-axis shift amount of the first image and the x-axis shift amount of the second image may be different from each other.

Referring to FIG. 6B, the display area may include a first display area DA1 divided into a first area SAy1*a*, a second area SAy2*a* and a third area SAy3*a* along the y-axis. Accordingly, the display area may include a second display area DA2 divided into a first area SAy1*b*, a second area SAy2*b* and a third area SAy3*b* along the y-axis.

In an exemplary embodiment, the first area SAy1*a* of the first display area and the first area SAy1*b* of the second display area are set to the y-axis reduced area, and the second area SAy2*a* of the first display area and the second area SAy1*b* of the second display area are set to the y-axis enlarged area. However, the first area SAy1*a* of the first display and the first area SAy1*b* of the second display area may be set to the y-axis enlarged area, and the second area SAy2*a* of the first display area and the second area SAy2*b* of the second display area may be set to the y-axis reduced area.

Also, the third area SAy3*a* of the first display area and the third area SAy3*b* of the second display area may be set to the y-axis shift area.

The image corrector 210 may reduce the initial image displayed in the y-axis reduced area, enlarge the initial image displayed in the y-axis enlarged area, shift and the initial image displayed in the y-axis shift area.

The y-axis shift area refers to an image that is not reduced or enlarged.

The corrected image generated by the image corrector 210 may be displayed by shifting a certain amount in a certain direction compared to the initial image.

Here, the first image displayed in the first display area DA1 and the second image displayed in the second image display DA2 may shift along the same y-axis direction.

In an exemplary embodiment, for example, but without limitation thereto, the first image and the second image may be moved simultaneously along the negative y-axis direction or may be moved simultaneously along the positive y-axis direction. However, when the first image moves along the negative y-axis direction, the second image may move along the positive y-axis direction.

In accordance with an exemplary embodiment, the y-axis shift amount of the first image and the y-axis shift amount of the second image may be the same.

In accordance with another exemplary embodiment, the y-axis shift amount of the first image and the y-axis shift amount of the second image may be different from each other.

Referring to FIG. 7, when the image corrector generates the corrected image according to the set area as shown in FIGS. 6A and 6B, the first display area DA1 and the second display area DA2 may each be divided into a plurality of shift areas.

In an exemplary embodiment, it is assumed that shift areas DA1*a*, DA1*d* and DA1*g* located on one side of the first display area DA1 and shift areas DA2*a*, DA2*d* and DA2*g* located on one side of the second display area DA2 may be set to the x-axis reduced area. It is also assumed that shift areas DA1*c*, DA1*f* and DA1*i* located on the other side of the first display area DA1 and shift areas DA2*c*, DA2*f* and DA2*i* located on the other side of the second display area DA2 may be set to the x-axis enlarged area. It is further assumed that shift areas DA1*b*, DA1*e* and DA1*h* located between the x-axis reduced area and the x-axis enlarged area of the first display area DA1 and shift areas DA2*b*, DA2*e* and DA2*h* located between the x-axis reduced area and the x-axis enlarged area of the second display area DA2 are set to the x-axis shift area.

In addition, it is assumed that the shift areas DA1*a*, DA1*b* and DA1*c* located on another side of the first display area DA1 and the shift areas DA2*a*, DA2*b* and DA2*c* located on another side of the second display area DA2 are set to the negative y-axis reduced area. It is also assumed that the shift areas DA1*g*, DA1*h* and DA1*i* located on the other side of the first display area DA1 and the shift areas DA2*g*, DA2*h* and DA2*i* located on the other side of the second display DA2 may be set to the y-axis enlarged area. It is further assumed that the shift areas DA1*d*, DA1*e* and DA1*f* located between the y-axis reduced area and the y-axis enlarged area of the first display area DA1 and the shift areas DA2*d*, DA2*e* and DA2*f* located between the y-axis reduced area and the y-axis enlarged area of the second display area DA2 may be set to the y-axis shift area.

When a pixel shift is performed by the image corrector 210, the initial image displayed in the first shift area DA1*a* of the first display area and the first shift area DA2*a* of the second display area may be displayed in a corrected image reduced in the x-axis direction and the positive y-axis direction.

Furthermore, the initial image displayed in the second shirt area DA1*b* of the first display area and the second shift area DA2*b* of the second display area may be displayed in a corrected image that is simply moved along the negative x-axis direction and reduced in the positive y-axis direction.

Also, the initial image displayed in the third shift area DA1*c* of the first display area and the third shift area DA2*c* of the second display area may be displayed in a corrected image that is enlarged along the negative x-axis direction and reduced in the positive y-axis direction.

In addition, the initial image displayed in the fourth shift area DA1*d* of the first display area and the fourth shift area DA2*d* of the second display area may be displayed in a corrected image that is reduced along the negative x-axis direction and simply moved along the positive y-axis direction.

Furthermore, the initial image displayed in the fifth shift area DA1*e* of the first display area and the fifth shift area DA2*e* of the second display area may be displayed in a corrected image that is simply moved in the negative x-axis direction and the positive y-axis direction.

Also, the initial image displayed in the sixth shift area DA1*f* of the first display area and the sixth shift area DA2*f* of the second display area may be displayed in a corrected image that is enlarged along the negative x-axis direction and simply moved along the positive y-axis direction.

In addition, the initial image displayed in the seventh shift area DA1*g* of the first display area and the seventh shift area DA2*g* of the second display area may be displayed in a corrected image that is reduced along the negative x-axis direction and enlarged along the positive y-axis direction.

Furthermore, the initial image that is displayed in the eighth shift area DA1*h* of the first display area and the eighth shift area DA2*h* of the second display area may be displayed in a corrected image that is simply moved along the negative x-axis direction and enlarged in the positive y-axis direction.

Also, the initial image displayed in the ninth shift area DA1*i* of the first display area and the ninth shift area DA2*i* of the second display area may be displayed in a corrected image that is enlarged along the negative x-axis direction and the positive y-axis direction.

Figure 8A:
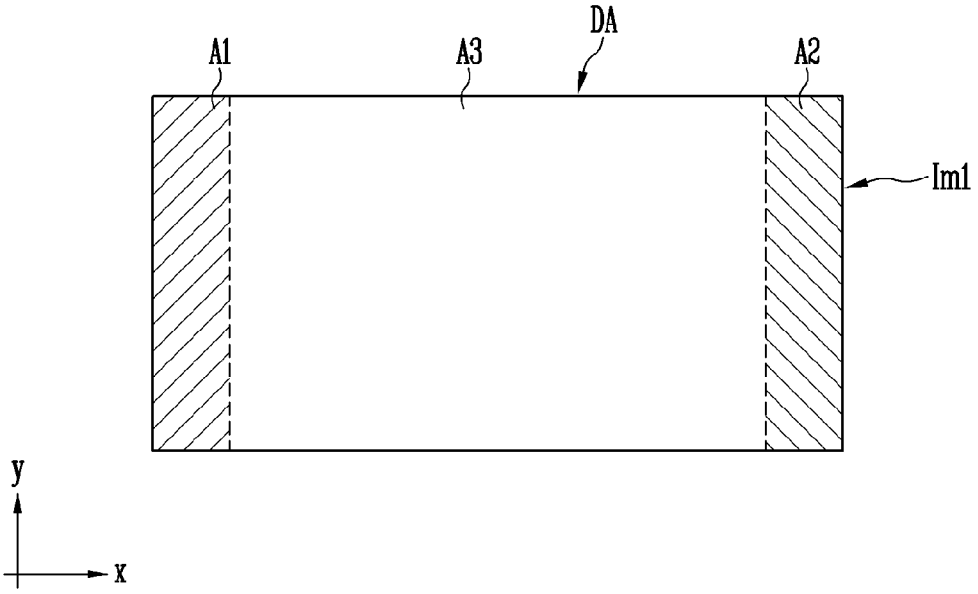
FIGS. 8A and 8B are conceptual diagrams for illustrating an exemplary embodiment of x-axis image movement according to the invention.
Figure 8B:
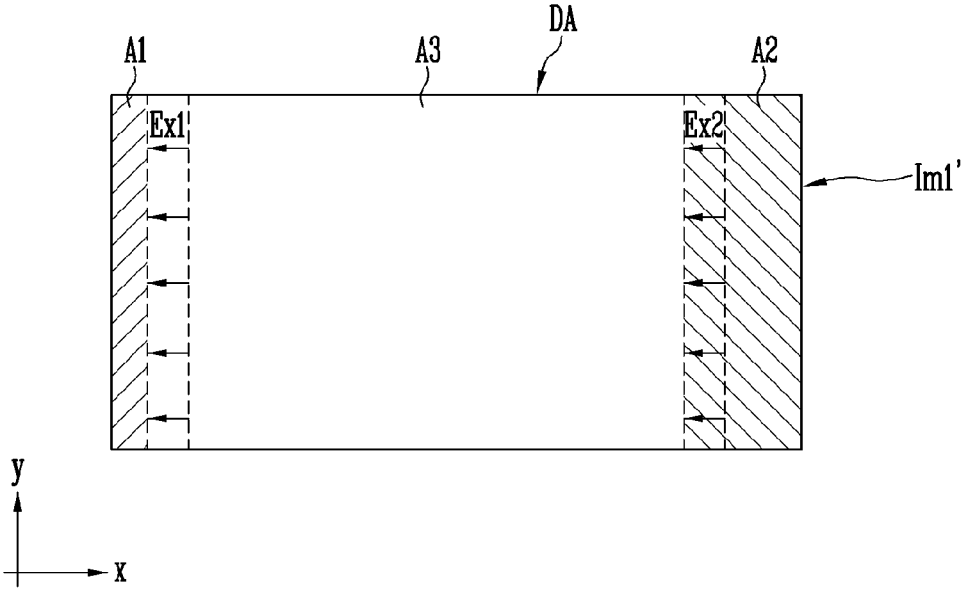

FIGS. 8A and 8B are conceptual diagrams for illustrating x-axis image shift in accordance with an exemplary embodiment.

For convenience in illustration regarding x-axis shifting of the first image displayed in the first display area DA1 and the second image displayed in the second display area DA2 shown in FIGS. 2 to 6B, a method for displaying a corrected image generated by shifting an initial image displayed in a display area DA in the x-axis direction is described with reference to FIGS. 8A and 8B.

In the exemplary embodiment, a method for displaying a first image displayed in a first display area DA1 and a method for displaying a second image in a second display area DA2 are the same as the method for displaying the corrected image in the display area DA.

Referring to FIG. 8A, a display device 10 (refer to FIG. 1) may display an initial image Im1 on the display area DA during an n-th period (where n is a natural number).

In an exemplary embodiment, a size of the initial image Im1 may be set less than that of the display area DA.

The initial image Im1 may include a plurality of areas. In an exemplary embodiment, but without limitation thereto, the initial image Im1 may include a first area A1, a second area A2 and a third area A3.

The third area A3 may be an area that is positioned between the first area A1 and the second area A2.

Also, the first area A1 may be an area positioned on a left side of the third area A3, and the second area A2 may be an area positioned on a right side of the third area A3.

In the method for displaying image in the display device 10 in accordance with an exemplary embodiment, the initial image Im1 may be moved and displayed, and certain areas included in the initial image Im1 may be reduced and enlarged.

In an exemplary embodiment, for example, but without limitation thereto, the image Im1 may be displayed on a certain location of the display area DA during the n-th period, and the initial image Im1 may be displayed as shifted in a certain direction (e.g., x-axis direction) during a (n+m)-th period (where m is a natural number).

That is, the initial image Im1 may be shifted in the negative x-axis direction (e.g., left direction in the plan view) or positive x-axis direction (e.g., right direction in the plan view) for a certain distance.

Referring to FIG. 8B, the display device 10 (refer to FIG. 1) may display a corrected image Im1' in the display area DA during the (n+m)-th period. In an exemplary embodiment, but without limitation thereto, the display device 10 may display the corrected image Im1' on the display area DA in accordance with second image data DI2.

The image corrector 210 may set the first area A1 to the x-axis reduced area, and the second area A2 to the x-axis enlarged area. Here, the corrected image Im1' may be displayed by moving the initial image Im1 by a pixel shift operation.

As the image is shifted, an area of the first area A1 may be reduced as much as a first extension Ex1, and an area of the second area A2 may be enlarged as much as a second extension Ex2.

In an exemplary embodiment, for example, but without limitation thereto, the first area A1 and the second area A2 of the initial image Im1 may maintain a certain area during a n-th period, and the first area A1 of the corrected image Im1' may be reduced as much as the first extension Ex1 and the second area A2 may be enlarged as much as the second extension Ex2 during the (n+m)-th period.

In an exemplary embodiment, the second area A2 may be enlarged as much as the first area A1 is reduced. In an exemplary embodiment, but without limitation thereto, the first extension Ex1 may be the same as the second extension Ex2, for example.

Accordingly, the display device 10 may shift the initial image Im1 to the corrected image Im1' while maintaining the entire size.

In other words, the size of the corrected image Im1' displayed in accordance with an exemplary embodiment may be of the same size of the initial image Im1 prior to being shifted.

The initial image Im1 may move along a direction in which the first area A1 is reduced.

The image corrector 210 may set a third area to the x-axis shift area. Accordingly, the third area A3 positioned between the first area A1 and the second area A2 may move along a direction in which the first area A1 is reduced. Here, the third area A3 may maintain its size, without being either reduced or enlarged.

In FIGS. 8A and 8B, an area positioned on a left side of the initial image Im1 and the corrected image Im1' is referred to as the first area A1, and an area positioned on a right side of the initial image Im1 and the corrected image Im1' is referred to as the second area A2. However, the first area A1 may be the second area A2, and vice versa.

In an exemplary embodiment, for example, the area positioned on the right side of the initial image Im1 and the corrected image Im1' may be set to the first area A1, and the area positioned on the left side of the initial image Im1 and the corrected image Im1' may be set to the second area A2.

As described above, by shifting the initial image Im1, afterimage may be prevented from occurring, and at the same time, reduction and enlargement of inner areas A1 and A2 of the initial image Im1 may be performed. As a result, afterimage phenomenon may be more effectively avoided.

Figure 9:
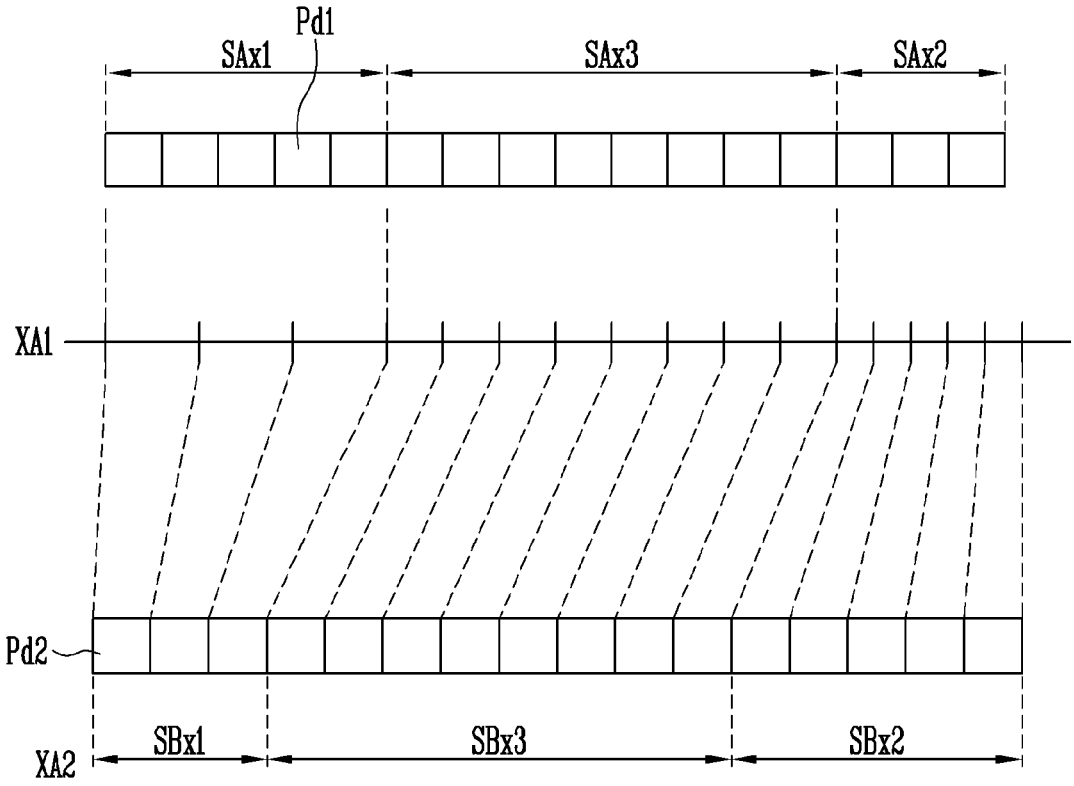
FIG. 9 is a conceptual diagram for illustrating an exemplary embodiment of a method for generating image data according to x-axis image movement of an image corrector in accordance with the invention.

FIG. 9 is a conceptual diagram for explaining a method for generating image data according x-axis image shift of an image corrector in accordance with an exemplary embodiment.

In FIG. 9, for convenience in illustration x-axis image data is shown which is to be input in pixels in one row among pixels arranged in lattice form, and image data Pd1 or Pd2 refers to data displaying images to pixels. Also, it is assumed that the first image data DI1 (refer to FIG. 1) includes the image data Pd1, and the second image data DI2 (refer to FIG. 1) includes the image data Pd2.

An x-axis area determiner 216-1 (refer to FIG. 2) may divide an initial image into sub-areas SAx1, SAx2 and SAx3 along the x-axis direction.

Here, an x-axis pre-shifting area XA1 may include pre-shifting sub-areas SAx1, SAx2 and SAx3. Also, an x-axis area after the shifting XA2 may include sub areas SBx1, SBx2 and SBx3 after image is shifted.

In an exemplary embodiment, for example, but without limitation thereto, the x-axis area determiner 216-1 may determine the initial image Im1 (refer to FIG. 8A) displayed on the pixel positioned fifth in the right side direction from the pixel positioned on the leftmost side to be the first pre-shifting area SAx1, determine the initial image Im1 displayed on the pixel positioned third in the left side direction from the pixel positioned on the rightmost side to be the second pre-shifting area SAx2, and determine the initial image Im1 positioned between the first pre-shifting area SAx1 and the second pre-shifting area SAx2 to the third pre-shifting area SAx3.

The image data generator 218 (refer to FIG. 2) may generate the image data Pd2 such that the image data Pd1 displaying the sub areas SAx1, SAx2 and SAx3 may display the sub areas SBx1, SBx2 and SBx3.

That is, the image data generator 218 may convert the image data Pd1 displaying the first pre-shifting area SAx1 into the image data Pd2 displaying the first post-shifting area SBx1.

Also, the image data generator 218 may convert the image data Pd1 displaying the second pre-shifting area SAx2 into the image data Pd2 displaying the second post-shifting area SBx2.

Also, the image data generator 218 may convert the image data Pd1 displaying the third pre-shifting area SAx3 into the image data Pd2 displaying the third post-shifting area SBx3.

Figure 10:
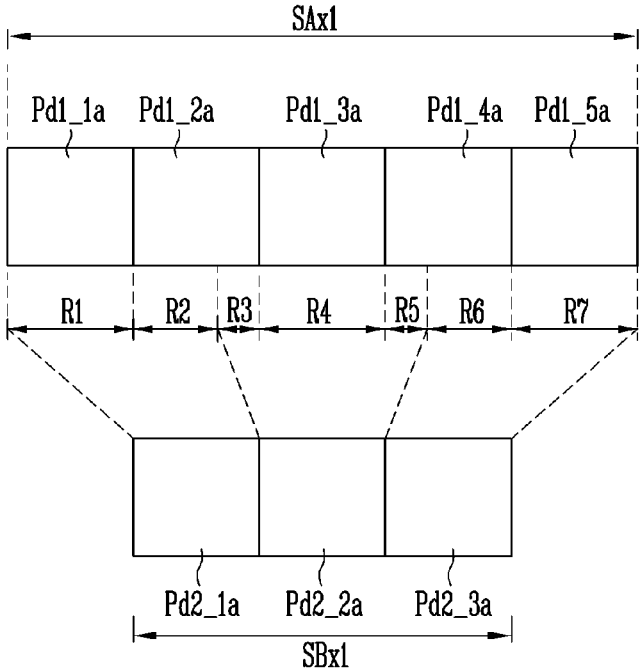
FIG. 10 is a conceptual diagram for illustrating a reduction area shown in FIG. 9.

FIG. 10 is a conceptual diagram for explaining a reduced area shown in FIG. 9.

Referring to FIGS. 9 and 10, the x-axis area determiner 216-1 (refer to FIG. 2) may determine the first post-shifting area SBx1 which is further reduced than the first pre-shifting area SAx1, using the image shift direction information SDI (refer to FIG. 2) and the image shift amount information SAI (refer to FIG. 2) generated by the shift determiner 214.

In an exemplary embodiment, for example, but without limitation thereto, when the image shift direction information SDI is set to the negative x-axis direction and the image shift amount information SAI is set to n pixel shifting (where n is a positive number), the x-axis area determiner 216-1 may set the first post-shifting area SBx1 which is reduced by n pixel shifting in the negative x-axis direction from the first pre-shifting area SAx1.

In accordance with an exemplary embodiment, the x-axis area determiner 216-1 may set the first post-shifting area SBx1, being reduced as much as the size of minute image, in the negative x-axis shift direction than the first pre-shifting area SAx1. The size of minute image is less than that of an image displayed on one pixel.

Thereafter, in order to reduce the initial image Im1, the image data generator 218 (refer to FIG. 2) may convert the initial image Im1 displayed on p pixels (where p is a positive number) of the first pre-shifting area SAx1 into the corrected image Im1' displayed on q pixels (where q is a positive number less than p) of the first post-shifting area SBx1.

That is, the image data generator 218 may convert the image data to be supplied to p pixels into the image data to be supplied to q pixels.

Since the initial image Im1 being displayed on p pixels is displayed on q pixels, the corrected image Im1' displayed in the first area SBx1 after the shift may be displayed on a reduced scale of k ratio compared to the image displayed in the first area SAx1 before the shift (where k=q/p).

Referring back to FIG. 10, the image data generator 218 (refer to FIG. 2) may recombine the image data Pd1_1*a*, Pd1_2*a*, Pd1_3*a*, Pd1_4*a* and Pd1_5*a* which displays the first pre-shifting area SAx1 and convert it into the image data Pd2_1*a*, Pd2_2*a* and Pd2_3*a* displaying the first post-shifting area SBx1.

For convenience in illustration, it is assumed that there are first pre-shifting area SAx1 which includes five pixels and image data Pd1_1*a*, Pd1_2*a*, Pd1_3*a*, Pd1_4*a* and Pd1_5*a* to be input into the five pixels and that the five pixels are sequentially arranged in the first pre-shifting area SAx1.

It is also assumed that the first post-shifting area SBx1 includes three pixels, and the three pixels are sequentially arranged.

The image data generator 218 (refer to FIG. 2) may generate image data Pd2_1*a*, Pd2_2*a* and Pd2_3*a* to be input into the three pixels using the image data Pd1_1*a*, Pd1_2*a*, Pd1_3*a*, Pd1_4*a* and Pd1_5*a* to be input into the five pixels.

In an exemplary embodiment, for example, but without limitation thereto, the image data generator 218 may generate the image data Pd2_1*a* to be input into a pixel positioned first from the left side in the first post-shifting area SBx1, using the image data Pd1_1*a* and Pd1_2*a* to be input into a pixel positioned first and a pixel positioned second from the left side in the first pre-shifting area SAx1.

That is, the image data generator 218 may generate the image data Pd1_1*a* displayed in an area R1 and the image data Pd1_2*a* displayed in an area R2.

Also, the image data generator 218 may generate the image data Pd2_2*a* using the image data Pd1_2*a* displayed in an area R3, the image data Pd1_3*a* displayed in an area R4 and the image data Pd1_4*a* displayed in an area R5 (where R2=R3+R5).

Also, the image data generator 218 may generate the image data Pd2_3*a* using the image data Pd1_4*a* displayed in an area R6 and the image data Pd1_5*a* displayed in an area R7 (where R2=R6).

In the first post-shifting area SBx1, the display device may display an image which is reduced further than the image displayed in the first pre-shifting area SAx1 using the image data Pd2_1*a*, Pd2_2*a* and Pd2_3*a* generated by the image data generator 218.

In an exemplary embodiment, the image displayed in the first pre-shifting area SAx1 may be displayed in the first post-shifting area SBx1 on a reduced scale of ⅗, for example.

Accordingly, the image displayed on the pixel positioned first from the left side in the first post-shifting area SBx1 may be reduced further than the image prior to the shift, and may be shifted as much as the area R2 in the negative x-axis direction.

Also, the image displayed in the pixel positioned second from the left side in the first post-shifting area SBx1 may be reduced further than the image prior to the shift, and may be shifted as much as the area R2 in the negative x-axis direction.

Also, the image displayed in the pixel positioned third from the left side in the first post-shifting area SBx1 may be reduced further than the image prior to the shift, and may be shifted as much as the area R2 in the negative x-axis direction.

Figure 11:
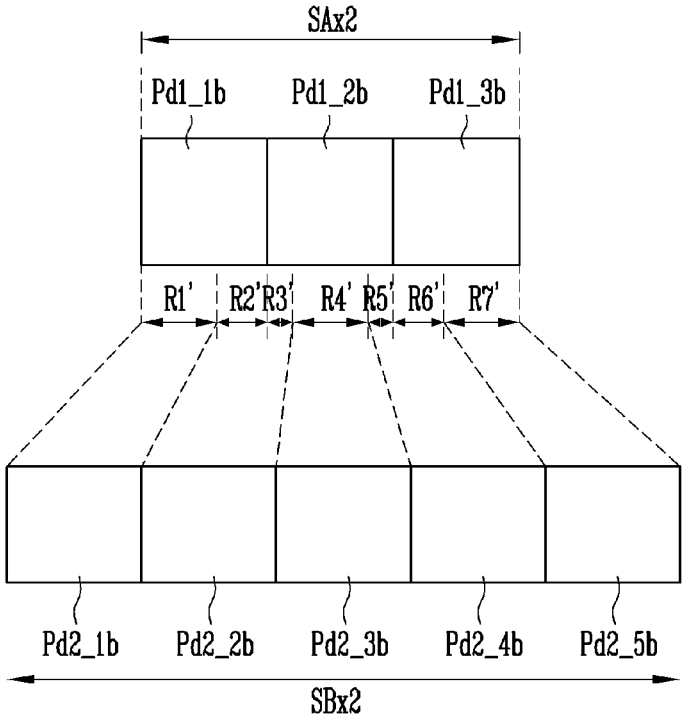
FIG. 11 is a conceptual diagram for illustrating an enlargement area shown in FIG. 9.

FIG. 11 is a conceptual diagram for explaining an enlarged area shown in FIG. 9.

Referring to FIGS. 9 and 11, the x-axis area determiner 216-1 (refer to FIG. 2) may determine the second post-shifting area SBx2 which is further enlarged than the second pre-shifting area SAx2, using the image shift direction information SDI (refer to FIG. 2) and the image shift amount information SAI (refer to FIG. 2) generated by the shift determiner 214 (refer to FIG. 2).

In an exemplary embodiment, for example, but without limitation thereto, when the image shift direction information SDI is set to the negative x-axis direction and the image shift amount information SAI is set to n pixel shifting (where n is a positive number), the x-axis area determiner 216-1 may set the second post-shifting area SBx2 which is enlarged by n pixel shifting in the negative x-axis direction than the second pre-shifting area SAx2.

Thereafter, in order to enlarge the initial image Im1, the image data generator 218 (refer to FIG. 2) may convert the initial image Im1 displayed on j pixels (where j is a positive number) of the second pre-shifting area SAx2 into the corrected image Im1' displayed on i pixels (where i is a positive number less than j) of the second post-shifting area SBx2.

That is, the image data generator 218 may convert the image data to be supplied to j pixels into the image data to be supplied to i pixels.

Since the initial image Im1 being displayed on j pixels is displayed on i pixels, the corrected image Im1' displayed in the second post-shifting area SBx2 may be displayed on an enlarged scale of k' ratio than the initial image Im1 displayed in the second pre-shifting area SAx2 (where k'=i/j).

Referring back to FIG. 9, the image data generator 218 may recombine the image data Pd1_1*b*, Pd1_2*b* and Pd1_3*b* which displays the second pre-shifting area SAx2 and convert it into the image data Pd2_1*b*, Pd2_2*b*, Pd2_3*b*, Pd2_4*b* and Pd2_5*b* displaying the second post-shifting area SBx2.

For convenience in illustration, it is assumed that there are second pre-shifting area SAx2 which includes three pixels and image data Pd1_1*b*, Pd1_2*b*, and Pd1_3*b* to be input into the three pixels and that the three pixels are sequentially arranged in the second pre-shifting area SAx2.

It is also assumed that the second post-shifting area SBx2 includes five pixels, and the five pixels are sequentially arranged.

The image data generator 218 may generate image data Pd2_1*b*, Pd2_2*b*, Pd2_3*b*, Pd2_4*b* and Pd2_5*b* to be input into the five pixels using the image data Pd1_1*b*, Pd1_2*b* and Pd1_3*b* to be input into the three pixels.

In an exemplary embodiment, for example, but without limitation thereto, the image data generator 218 may generate the image data Pd2_1*b* to be input into a pixel positioned first from the left side in the second post-shifting area SBx2 using the image data Pd1_1*b* to be input into a pixel positioned first from the left side in the second pre-shifting area SAx2.

That is, the image data generator 218 may generate the image data Pd2_1*b* using the image data Pd1_1*b* displayed in an area R1'.

Also, the image data generator 218 may generate the image data Pd2_2*b* using the image data Pd1_1*b* displayed in an area R2' and the image data Pd1_2*b* displayed in an area R3' (where R1'=R2'+R3').

Also, the image data generator 218 may generate the image data Pd2_3*b* using the image data Pd1_2*b* displayed in an area R4' (where R1'=R4').

Also, the image data generator 218 may generate the image data Pd2_4*b* using the image data Pd1_2*b* displayed in an area R5' and the image data Pd1_3*b* displayed in an area R6' (where, R1'=R5'+R6').

Also, the image data generator 218 may generate the image data Pd2_5*b* using the image data Pd1_3*b* displayed in an area R7' (where R1'=R7').

The display device 10 (refer to FIG. 1) may display the corrected image Im1' in the second post-shifting area SBx2 using the image data Pd2_1*b*, Pd2_2*b*, Pd2_3*b*, Pd2_4*b* and Pd2_5*b* generated by the image data generator 218. The corrected image is enlarged further than the initial image Im1 displayed in the second pre-shifting area SAx2.

In an exemplary embodiment, the initial image Im1 displayed in the second pre-shifting area SAx2 may be displayed in the second post-shifting area SBx2 on an enlarged scale of 5/3, for example.

Accordingly, the corrected image Im1' displayed on the pixel positioned first from the left side in the second post-shifting area SBx2 may be enlarged further than the initial image Im1 prior to the shift and may be shifted as much as the area R2' in the negative x-axis direction.

Also, the corrected image Im1' displayed in the pixel positioned second from the left side in the second post-shifting area SBx2 may be enlarged further than the initial image Im1 prior to the shift and may be shifted as much as the area R2' in the negative x-axis direction, and the corrected image Im1' displayed in the pixel positioned third from the left side in the second post-shifting area SBx2 may be enlarged further than the initial image Im1 prior to the shift and may be shifted as much as the area R2' in the negative x-axis direction.

Also, the corrected image Im1' displayed in the pixel positioned fourth from the left side in the second post-shifting area SBx2 may be enlarged further than the initial image Im1 prior to the shift and may be shifted as much as the area R2' in the negative x-axis direction. The corrected image Im1' displayed in the pixel fifth from the left side in the second post-shifting area SBx2 may be enlarged further than the initial image Im1 prior to the shift and may be shifted as much as the area R2' in the negative x-axis direction.

Figure 12A:
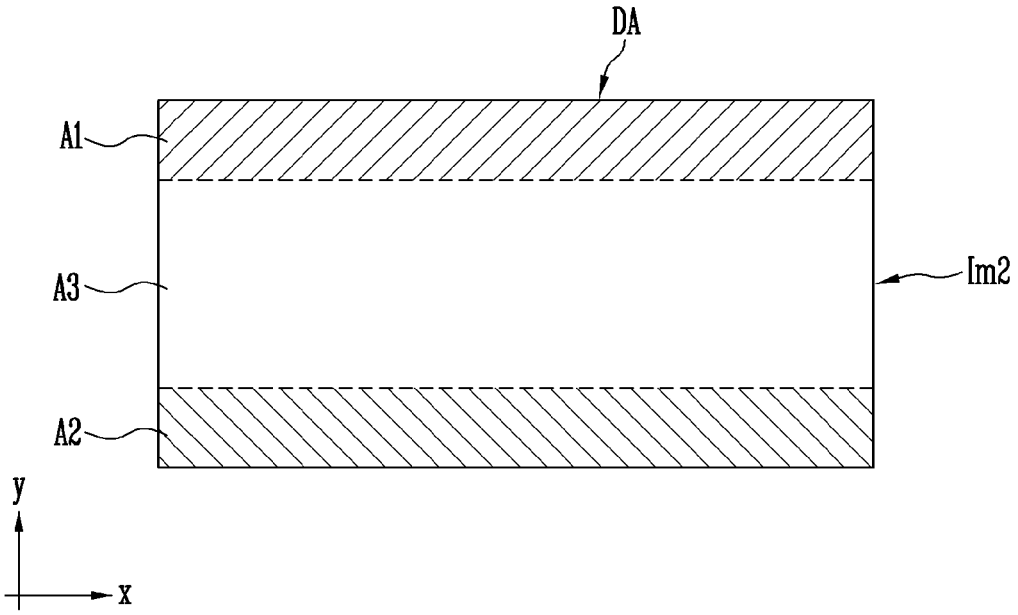
FIGS. 12A and 12B are conceptual diagrams for illustrating an exemplary embodiment of y-axis image movement according to the invention.
Figure 12B:
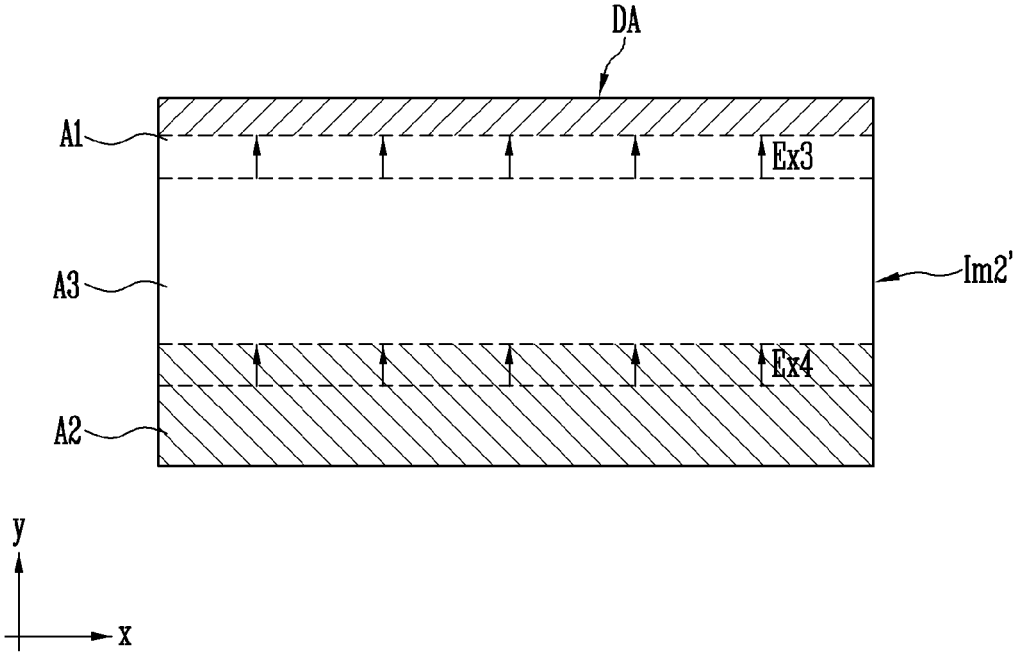

FIGS. 12A and 12B are conceptual diagrams for explaining y-axis image shift in accordance with an exemplary embodiment.

FIGS. 12A and 12B show image shifting along y-axis direction. Any repetitive description overlapping the exemplary embodiment relating to FIGS. 8A and 8B will be omitted.

Referring to FIG. 12A, an initial image Im2 may include a plurality of areas. In an exemplary embodiment, but without limitation thereto, the initial image Im2 may include a first area A1, a second area A2 and a third area A3, for example.

The third area A3 may be an area positioned between the first area A1 and the second area A2.

Also, the first area A1 may be an area positioned on an upper side of the third area A3, and the second area A2 may be an area positioned on a lower side of the third area A3.

In a method for displaying image by the display device 10 (refer to FIG. 1) in accordance with an exemplary embodiment, the initial image Im2 may be shifted and displayed, and certain portions included in the initial image Im2 may be reduced or enlarged.

In an exemplary embodiment, for example, but without limitation thereto, the initial image Im2 may be displayed in a certain position of the image display area DA during a n-th period, and the initial image Im2 may be displayed as being shifted in a certain direction (e.g., y-axis direction) during a (n+m)-th period (where m is a natural number that is 1 or greater).

That is, the initial image Im2 may be shifted in the negative y-axis direction (downwards) or positive y-axis direction (upwards) for a certain distance.

Referring to FIG. 12B, the display device 10 (refer to FIG. 1) may display a corrected image Im2' in the image display area DA during the (n+m)-th period.

The image corrector 210 (refer to FIG. 1) may set the first area A1 to a y-axis reduced area and set the second area A2 to a y-axis enlarged area. The corrected image Im2' may be the initial image Im2 shifted by a pixel shift operation and displayed.

The first area A1 may be reduced as much as a third extension Ex3 in accordance with image shifting, and the second area A2 may be enlarged as much as a fourth extension Ex4.

In an exemplary embodiment, for example, but without limitation thereto, the first area A1 and the second area A2 may maintain a consistent area during a n-th period, and during the (n+m)-th period, the first area A1 of the corrected image Im2' may be reduced as much as the third extension Ex3, and the second area A2 may be enlarged as much as the fourth extension Ex4.

The second area A2 may be enlarged as much as the first area A1 is reduced. In an exemplary embodiment, but without limitation thereto, the third extension Ex3 may be the same as the fourth extension Ex4, for example.

Accordingly, the display device 10 may shift the initial image Im2 to the corrected image Im2' while maintaining its size in entirety.

In other words, the size of the corrected image Im2' displayed in accordance with an exemplary embodiment may be maintained as the same size as that of the initial image Im2 prior to the shift.

The initial image Im2 may shift in a direction in which the first area A1 is reduced.

The image corrector 210 may set the third area A3 to a y-axis shift area. Therefore, the third area A3 positioned between the first area A1 and the second area A2 may shift along the direction in which the first area A1 is reduced. The third area A3 may not be either reduced or enlarged, and may maintain its size.

In FIGS. 12A and 12B, the area positioned on an upper side of the initial image Im2 and the corrected image Im2' is referred to as the first area A1, and the area positioned on a lower side of the initial image Im2 and the corrected image Im2' is referred to as the second area A2. However, the invention is not limited thereto, and the first area A1 and the second area A2 may be switched.

In an exemplary embodiment, for example, but without limitation thereto, the area positioned on the upper side of the initial image Im2 and the corrected image Im2' may be set to the first area A1, and the area positioned on the lower side of the initial image Im2 and the corrected image Im2' may be set to the second area A2.

As described above, by shifting the initial image Im2, afterimage may be prevented from occurring, and at the same time, reduction and enlargement of inner areas A1 and A2 of the initial image Im2 may be performed. As a result, afterimage phenomenon may be more effectively avoided.

Figure 13:
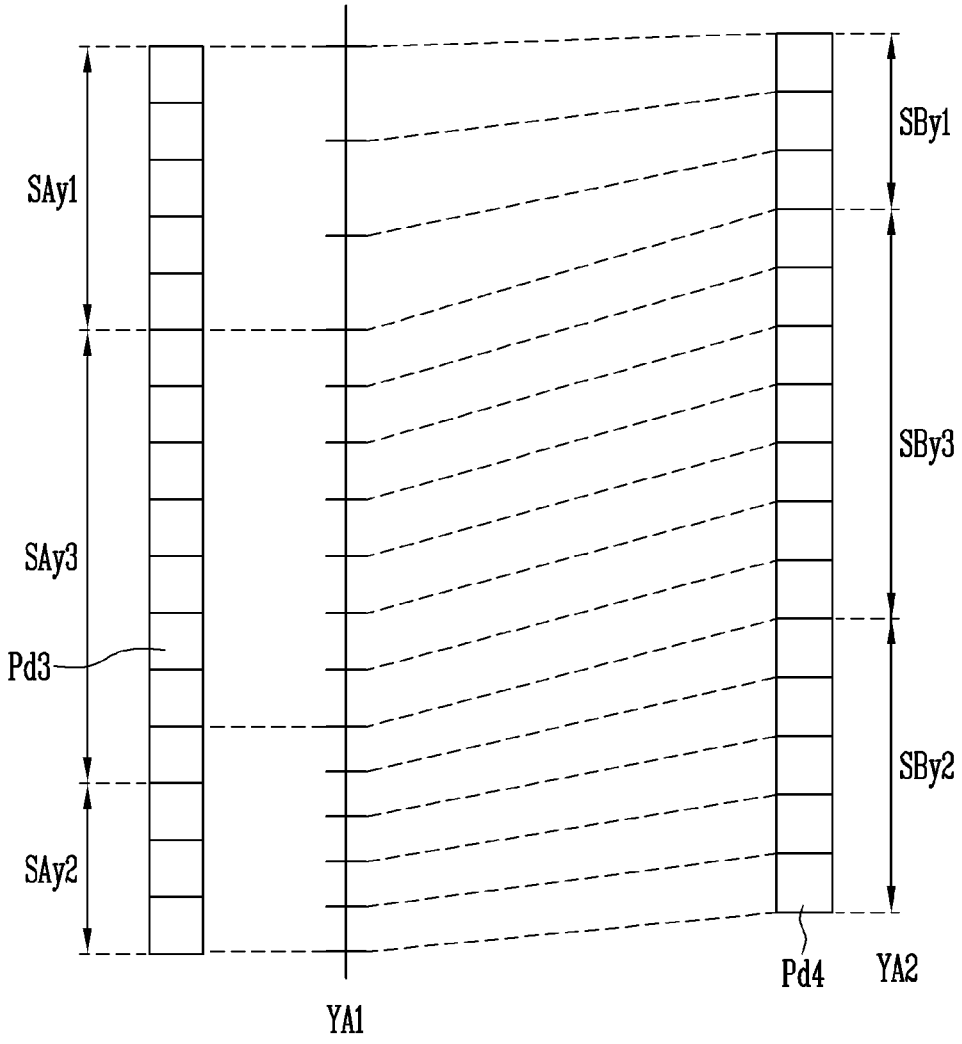
FIG. 13 is a conceptual diagram for illustrating an exemplary embodiment of a method for generating image data according to y-axis image movement of an image corrector according to the invention.

FIG. 13 is a conceptual diagram for explaining a method for generating image data according to y-axis image shift of an image corrector according to an exemplary embodiment.

In FIG. 13, for convenience in illustration y-axis image data is shown which is to be input in pixels in one row among pixels arranged in lattice form, and image data Pd3 or Pd4 refers to data displaying images to pixels. Also, it is assumed that the first image data DI1 includes the image data Pd3, and the second image data DI2 includes the image data Pd4.

The y-axis area determiner 216-2 (refer to FIG. 2) may divide an image into sub-areas SAy1, SAy2 and SAy3 along the y-axis direction.

The y-axis area YA1 prior to the shift may include the sub areas SAy1, SAy2 and SAy3 before the image is shifted.

Also, the y-axis area YA2 after the shift may include the sub areas SBy1, SBy2 and SBy3 after the image is shifted.

In an exemplary embodiment, for example, but without limitation thereto, the y-axis area determiner 216-2 may determine the initial image Im2 displayed on the pixel positioned fifth from the topmost pixel towards the bottom to a first pre-shifting area SAy1, determine the initial image Im2 displayed on the pixel positioned third from the lowermost pixel towards the top to a second pre-shifting area SAy2, and determine a third pre-shifting area SAy3 positioned between the first pre-shifting area SAy1 and the second pre-shifting area SAy2.

The image data generator 218 (refer to FIG. 2) may generate the image data Pd4 such that the image data Pd3 displaying the sub areas SAy1, SAy2 and SAy3 may display the sub areas SBy1, SBy2 and SBy3.

That is, the image data generator 218 may convert the image data Pd3 displaying the first pre-shifting area SAy1 into the image data Pd4 displaying the first post-shifting area SBy1.

Also, the image data generator 218 may convert the image data Pd3 displaying the second pre-shifting area SAy2 into the image data Pd4 displaying the second post-shifting area SBy2.

Also, the image data generator 218 may convert the image data Pd3 displaying the third pre-shifting area SAy3 into the image data Pd4 displaying the third post-shifting area SBy3.

Figure 14:
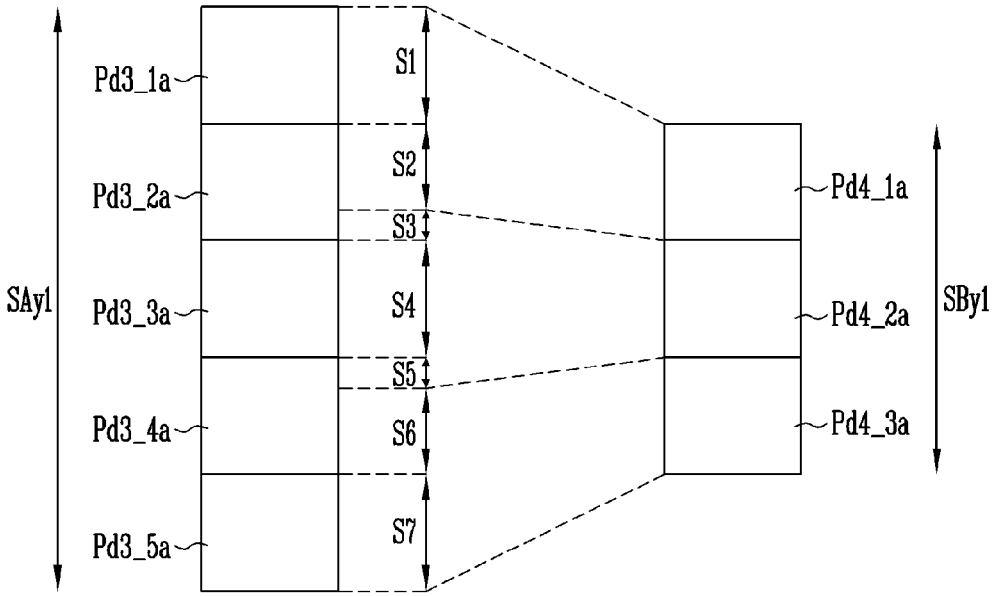
FIG. 14 is a conceptual diagram for illustrating a reduction area shown in FIG. 13.

FIG. 14 is a conceptual diagram for explaining a reduced area shown in FIG. 3.

Referring to FIGS. 13 and 14, the y-axis area determiner 216-2 may determine the first post-shifting area SBy1 which is further reduced than the first pre-shifting area SAy1 using image shift direction information SDI (refer to FIG. 2) and shift amount information SAI (refer to FIG. 2) generated by the shift determiner 214.

In an exemplary embodiment, for example, but without limitation thereto, when the image shift direction information SDI is set to the y-axis shift direction and the image shift amount information SAI is set to n pixel shifting (where n is a positive number), the y-axis area determiner 216-2 may set the first post-shifting area SBy1 which is further reduced by n pixel shifting in the y-axis direction than the first pre-shifting area SAy1.

In accordance with an exemplary embodiment, the x-axis area determiner 216-1 may set the first post-shifting area SBy1 which is reduced as much as the size of minute image in the y-axis shift direction than the first pre-shifting area SAy1 in a unit less than the size of the minute image displayed on one pixel.

Thereafter, in order to reduce image, the image data generator 218 may convert the initial image Im2 displayed on p pixels (where p is a positive number) of the first pre-shifting area SAy1 into the corrected image Im2' displayed on q pixels (where q is a positive number less than p) of the first post-shifting area SBy1.

That is, the image data generator 218 may convert the image data to be supplied to p pixels into the image data to be supplied to q pixels.

Since the initial image Im2 being displayed on p pixels is displayed as the corrected image Im2' on q pixels, the corrected image Im2' displayed in the first post-shifting area SBy1 may be displayed on a reduced scale of k ratio than the initial image Im2 displayed in the first pre-shifting area SAy1 (where k=q/p).

Referring back to FIG. 14, the image data generator 218 may recombine the image data Pd3_1*a*, Pd3_2*a*, Pd3_3*a*, Pd3_4*a* and Pd3_5*a* which displays the first pre-shifting area SAy1 and convert it into the image data Pd4_1*a*, Pd4_2*a* and Pd4_3*a* displaying the first post-shifting area SBy1.

For convenience in illustration, it is assumed that there are first pre-shifting area SAy1 which includes five pixels and image data Pd3_1*a*, Pd3_2*a*, Pd3_3*a*, Pd3_4*a* and Pd3_5*a* to be input into the five pixels and that the five pixels are sequentially arranged in the first pre-shifting area SAy1.

It is also assumed that the first post-shifting area SBy1 includes three pixels, and the three pixels are sequentially arranged.

The image data generator 218 may generate image data Pd4_1*a*, Pd4_2*a* and Pd4_3*a* to be input into the three pixels using the image data Pd3_1*a*, Pd3_2*a*, Pd3_3*a*, Pd3_4*a* and Pd3_5*a* to be input into the five pixels.

In an exemplary embodiment, for example, but without limitation thereto, the image data generator 218 may generate the image data Pd4_1*a* to be input into the pixel positioned first from the upper side in the first post-shifting area SBy1 using the image data Pd3_1*a* and Pd3_2*a* to be respectively input into the pixel positioned first and second from the upper side in the first pre-shifting area SAy1.

That is, the image data generator 218 may generate the image data Pd4_1*a* using the image data Pd3_1*a* displayed in an area S1 and the image data Pd3_2*a* displayed in an area S2.

Also, the image data generator 218 may generate the image data Pd4_2*a* using the image data Pd3_2*a* displayed in an area S3, the image data Pd3_3*a* displayed in an area S4 and the image data Pd3_4*a* displayed in an area S5 (where S2=S3+S5).

Also, the image data generator 218 may generate the image data Pd4_3*a* using the image data Pd3_4*a* displayed in an area S6 and the image data Pd3_5*a* displayed in an area S7 (where S2=S6).

The display device may display the corrected image Im2' which is reduced further than the initial image Im2 displayed in the first pre-shifting area SAy1 in the first post-shifting area SBy1 using the image data Pd4_1*a*, Pd4_2*a* and Pd4_3*a* generated by the image data generator 218.

In an exemplary embodiment, the initial image Im2 displayed in the first pre-shifting area SAy1 may be displayed as the corrected image Im2' in the first post-shifting area SBy1 on a reduced scale of ⅗, for example.

Accordingly, the corrected image Im2' displayed on the pixel positioned first from the upper side in the first post-shifting area SBy1 may be reduced further than the initial image Im2 prior to the shift and may be shifted as much as the area S2 in the positive y-axis direction.

Also, the corrected image Im2' displayed in the pixel positioned second from the upper side in the first post-shifting area SBy1 may be reduced further than the initial image Im2 prior to the shift and may be shifted as much as the area S2 in the positive y-axis direction, and the corrected image Im2' displayed in the pixel positioned third from the upper side in the first post-shifting area SBy1 may be reduced further than the initial image Im2 prior to the shift and may be shifted as much as the area S2 in the positive y-axis direction.

Figure 15:
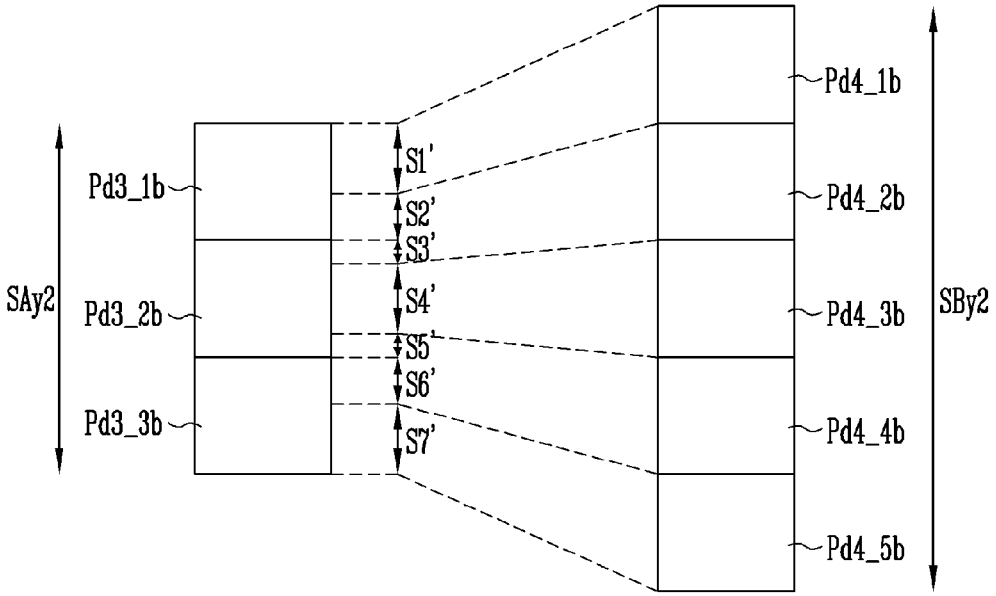
FIG. 15 is a conceptual diagram for illustrating an enlargement area shown in FIG. 13.

FIG. 15 is a conceptual diagram for explaining an enlarged area shown in FIG. 13.

Referring to FIGS. 13 and 15, the y-axis area determiner 216-2 (refer to FIG. 2) may determine the second post-shifting area SBy2 which is enlarged further than the second pre-shifting area SAy2 using the image shift direction information SDI (refer to FIG. 2) and image shift amount information SAI (refer to FIG. 2) generated by the shift determiner 214.

If the image shift direction information SDI is set to positive y-axis shift direction and the shift image shift amount information SAI is set to n pixel shifting (where n is a positive number), the y-axis area determiner 216-2 may set the second post-shifting area SBy2 which is enlarged as much as n pixel shifting in the positive y-axis shift direction than the second pre-shifting area SAy2.

Thereafter, in order to enlarge the initial image Im2, the image data generator 218 (refer to FIG. 2) may convert the initial image Im2 displayed in j pixels (where j is a positive number) of the second pre-shifting area SAy2 into the corrected image Im2' displayed in i pixels (where i is a positive number greater than j) of the second post-shifting area SBy2.

The image data generator 218 may convert the image data to be supplied to the j pixels into the image data to be supplied to the i pixels.

Since the initial image Im2 displayed in the j pixels is displayed in the i pixels, the corrected image Im2' displayed in the second post-shifting area SBy2 may be displayed as further enlarged than the initial image Im2 displayed in the second pre-shifting area SAy2 on an enlarged scale of k' (where k'=i/j).

Referring back to FIG. 15, the image data generator 218 may recombine the image data Pd3_1*b*, Pd3_2*b* and Pd3_3*b* displaying the second pre-shifting area SAy2 and convert it into the image data Pd4_1*b*, Pd4_2*b*, Pd4_3*b*, Pd4_4*b* and Pd4_5*b* displaying the second post-shifting area SBy2.

For convenience in illustration, it is assumed that there are second pre-shifting area SAy2 which includes three pixels and image data Pd3_1*b*, Pd3_2*b* and Pd3_3*b* to be input into the three pixels and that the three pixels are sequentially arranged in the second pre-shifting area SAy2.

It is also assumed that the second post-shifting area SBy2 may include five pixels, and the five pixels are sequentially arranged.

The image data generator 218 may generate the image data Pd4_1*b*, Pd4_2*b*, Pd4_3*b*, Pd4_4*b* and Pd4_5*b* to be input into the five pixels using the image data Pd3_1*b*, Pd3_2*b* and Pd3_3*b* to be input into the three pixels.

In an exemplary embodiment, for example, but without limitation thereto, the image data generator 218 may generate the image data Pd4_1*b* to be input into a pixel positioned first from the upper side in the second post-shifting area SBy2 using the pixel Pd3_1*b* to be input into a pixel positioned first from the upper side in the second pre-shifting area SAy2.

The image data generator 218 may generate image data Pd4_1*b* using the image data Pd3_1*b* displayed in an area S1'.

Also, the image data generator 218 may generate image data Pd4_2*b* using the image data Pd3_1*b* displayed in an area S2' and the image data Pd3_2*b* displayed in an area S3' (where S1'=S2'+S3').

Also, the image data generator 218 may generate the image data Pd4_3*b* using the image data Pd3_2*b* displayed in an area S4' (where S1'=S4').

Also, the image data generator 218 may generate the image data Pd4_4*b* using the image data Pd3_2*b* displayed in an area S5' and the image data Pd3_3*b* displayed in an area S6' (where S1'=S5'+S6').

Also, the image data generator 218 may generate image data Pd4_5*b* using the image data Pd3_3*b* displayed in an area S7' (where S1'=S7').

The display device 10 (refer to FIG. 1) may display the corrected image Im2' which is further enlarged than the initial image Im2 displayed in the second pre-shifting area SAy2 in the second post-shifting area SBy2 using the image data Pd4_1*b*, Pd4_2*b*, Pd4_3*b*, Pd4_4*b* and Pd4_5*b* generated by the image data generator 218.

In an exemplary embodiment, the initial image Im2 displayed in the second pre-shifting area SAy2 may be displayed as the corrected image Im2' in the second post-shifting area SBy3 on an enlarged scale of 5/3 ratio, for example.

The corrected image Im2' displayed in the pixel positioned first from the upper side in the second post-shifting area SBy2 may be enlarged and shifted in the positive y-axis direction as much as the area S2' than the initial image Im2 prior to the shift.

Also, the corrected image Im2' displayed in the pixel positioned second from the upper side in the second post-shifting area SBy2 may be enlarged and shifted in the positive y-axis direction as much as the area S2' than the initial image Im2 prior to the shift, and the corrected image Im2' displayed in the pixel positioned third from the upper side in the second post-shifting area SBy2 may be enlarged and shifted in the positive y-axis direction as much as S2' than the initial image Im2 prior to the shift.

Also, the corrected image Im2' displayed in the pixel positioned fourth from the upper side in the second post-shifting area SBy2 may be enlarged and shifted in the positive y-axis direction as much as the area S2' than the initial image Im2 prior to the shift, and the corrected image Im2' displayed in the pixel positioned fifth from the upper side in the second post-shifting area SBy2 may be enlarged and shifted in the positive y-axis direction as much as S2' than the initial image Im2 prior to the shift.

Figure 16:
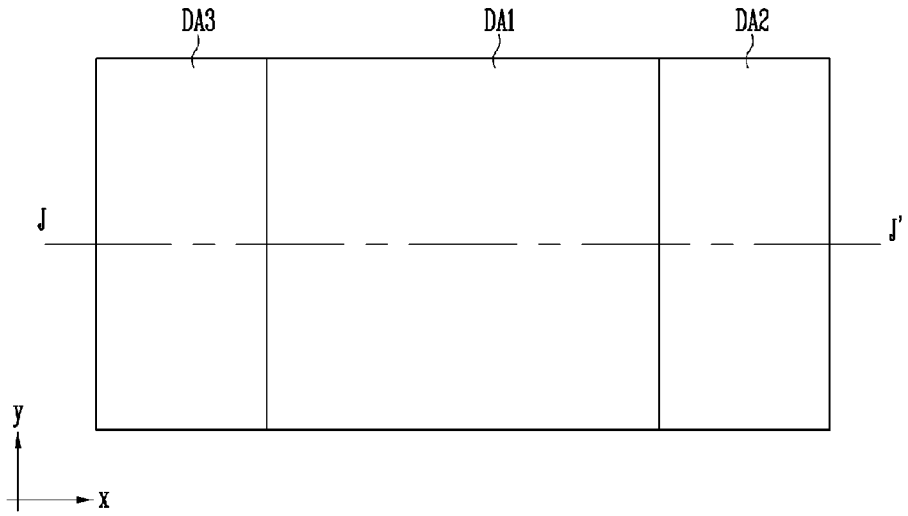
FIG. 16 is a plan view for illustrating another exemplary embodiment of a display panel of a display device according to the invention.
Figure 17:
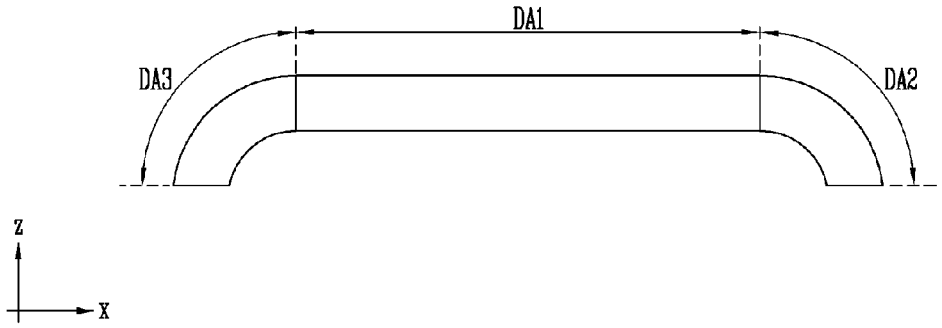
FIG. 17 is a cross-sectional view along J-J' in FIG. 16.

FIG. 16 is a plan view of a display panel of a display device in accordance with another exemplary embodiment. FIG. 17 is a cross-sectional view along line J-J' shown in FIG. 16.

The first display area and the second display area shown in FIGS. 16 and 17 are substantially the same as the first display area and the second display area shown in FIGS. 4 and 5. Therefore, repetitive description will be omitted.

Referring to FIGS. 16 and 17, the display device 10 (refer to FIG. 1) may include a first display area DA1 which is an area that appears on a front surface of a display panel 300, a second display area DA2 that extends from one side of the first display area DA1 and has a bent shape on a side surface of the display device 10 and a third display area DA3 positioned in a direction facing the second display area DA2.

That is, the display device 10 may include the first display area DA1 in a flat form and the second display area DA2 and the third display area DA3 having a bent shape having an operable radius of curvature or less.

The third display area DA3 may include a bent display area having twisted or bent shape without any damage due to a substrate that is as thin as a paper and flexible as the second display area DA2.

The first display area DA1 may display first image, the second display area DA2 may display second image and the third display area DA3 may display third image. Here, image shift of the first image may be performed only in the first display area DA1, image shift of the second image may be performed only in the second display area DA2, and image shift of the third image may be performed only in the third display area DA3.

Here, the first image, the second image and the third image may be shifted along the same x-axis direction, or different x-axis direction.

Also, the first image, the second image, and the third image may be shifted along the same y-axis direction.

Figure 18:
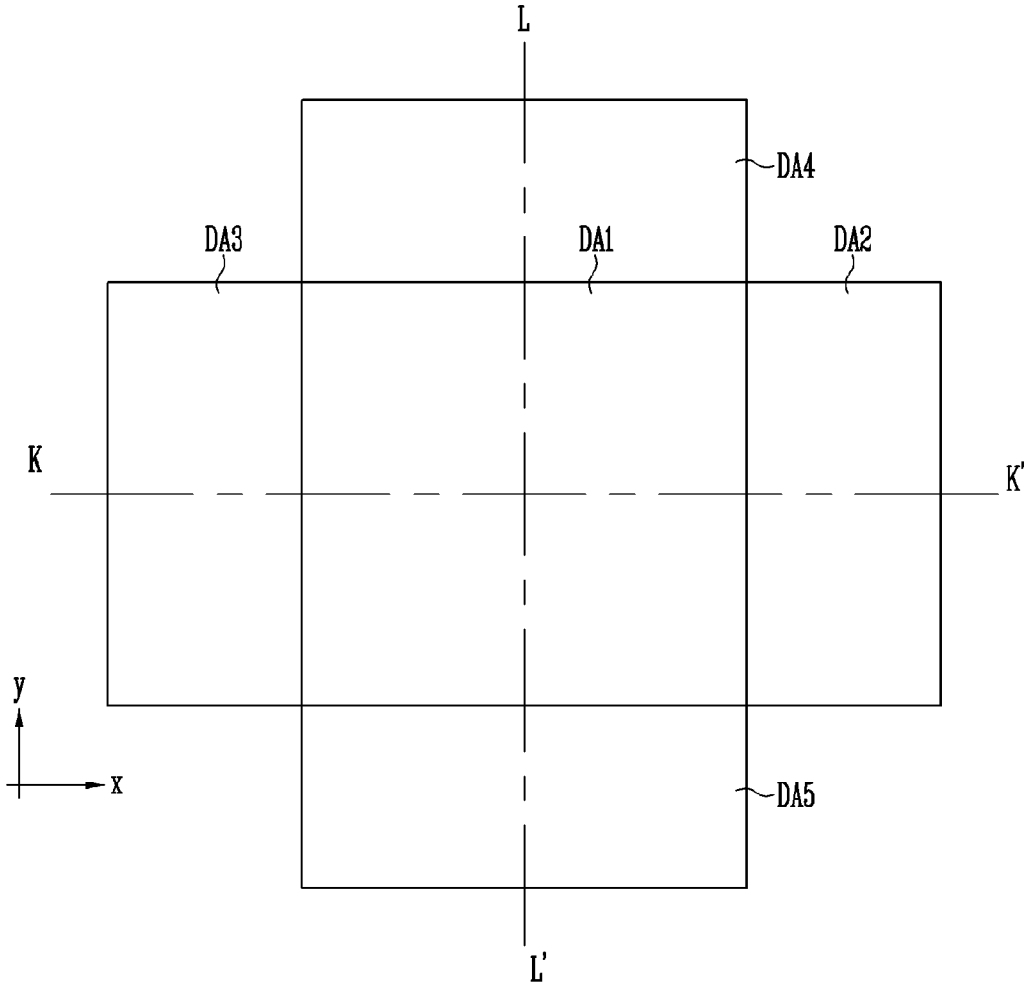
FIG. 18 is a plan view illustrating another exemplary embodiment of a display panel of a display device according to the invention.
Figure 19A:
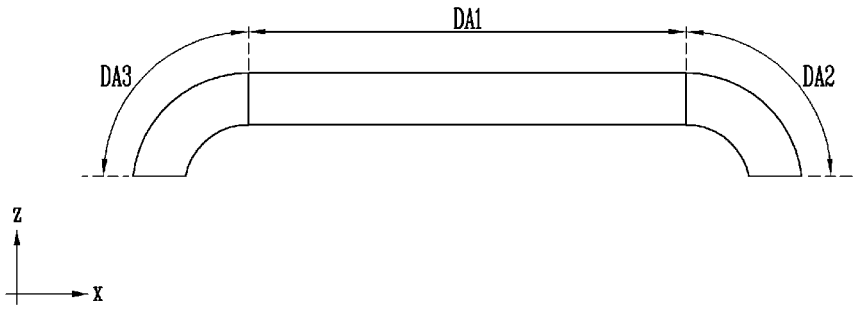
FIG. 19A is a cross-sectional view along K-K' in FIG. 18.
Figure 19B:
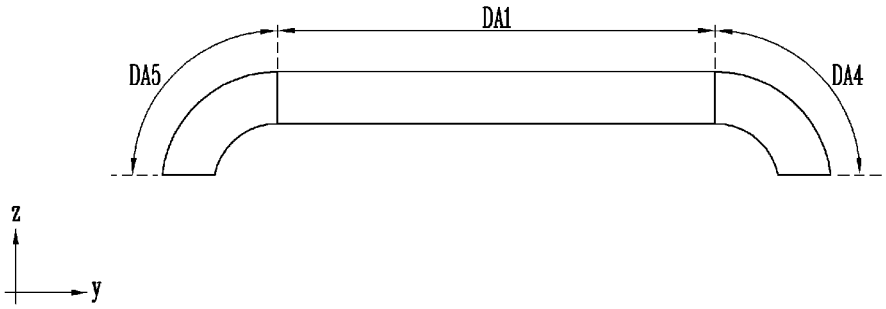
FIG. 19B is a cross-sectional view along L-L' in FIG. 18.

FIG. 18 is a plan view of a display panel of a display device in accordance with yet another exemplary embodiment. FIG. 19A is a cross-sectional view along line K-K' shown in FIG. 18. FIG. 19B is a cross-sectional view along line L-L' shown in FIG. 18.

The first display area DA1, the second display area DA2 and the third display area DA3 shown in FIGS. 18 and 19A are the same as the first display area DA1, the second display area DA2 and the third display area DA3 shown in FIGS. 16 and 17. Thus, detailed description thereof will be omitted.

Referring to FIGS. 16 and 17, the display device 10 (refer to FIG. 1) may include the first display area DA1 which is an area that appears on a front surface of a display panel 300, the second display area DA2 that extends from one side of the first display area DA1 and has a bent shape on a side surface of the display device 10, the third display area DA3 positioned in a direction facing the second display area DA2, a fourth display area DA4 that extends from another side of the first display area DA1 and has a bent shape on a side surface of the display device, and a fifth display area DA5 positioned in a direction facing the fourth display area DA4.

The display device 10 may include the first display area DA1 in a flat form and the second display area DA2, the third display area DA3, the fourth display area DA4 and the fifth display area DA5 having a bent shape having an operable radius of curvature or less.

The fourth display area DA4 and the fifth display area DA5 may include bent display areas having twisted or bent shape without any damage due to a substrate that is as thin as a paper and flexible as the second display area DA2.

The fourth display area may display fourth image, and the fifth display area may display fifth image. Here, image shift of the fourth image may be performed only in the fourth display area DA4, and image shift of the fifth image may be performed only in the fifth display area DA5.

Here, the first image, the second image and the third image may be shifted along the same x-axis direction, or different x-axis direction. The first image, the fourth image and the fifth image may be shifted along the same x-axis direction.

Also, the first image, the second image and the third image may be shifted along the same y-axis direction. The first image, the fourth image and the fifth image may be shifted along the same y-axis direction, or different y-axis direction.

Figures 20, 21:
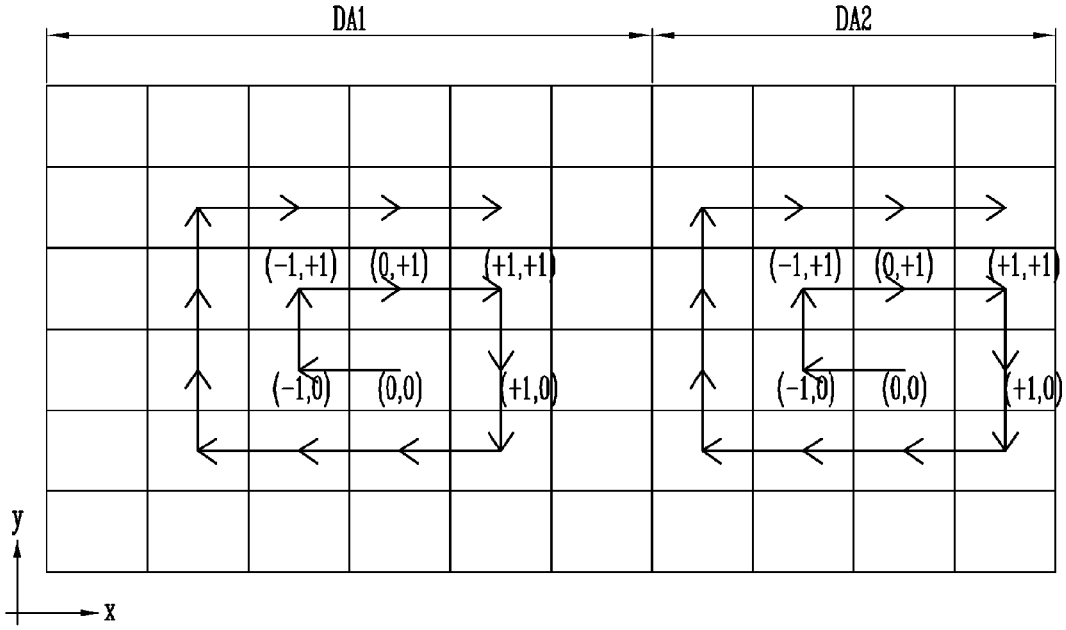
FIG. 20 is an exemplary embodiment of a look-up table in accordance with the invention.
FIG. 21 is a conceptual diagram for illustrating a method for moving image in a display device in accordance with a look-up table shown in FIG. 20.

FIG. 20 is a look-up table according to an exemplary embodiment. FIG. 21 is a conceptual diagram of a method for a display device to move image in accordance with the look-up table shown in FIG. 20.

Referring to FIG. 20, the look-up table LUT displays (+) when the x-axis shift direction SDx is positive direction (rightward), and displays (−) when the x-axis shift direction SDx is negative direction (leftward).

Also, the look-up table LUT displays (+) when the y-axis shift direction SDy is positive direction (upward), and displays (−) when the y-axis shift direction SDy is negative direction (downward).

However, the invention is not limited thereto, and a method of expressing the shift directions SDx and SDy may change in various manners.

A shift determiner 214 (refer to FIG. 2) may calculate, by referring to the pre-stored look-up table LUT the x-axis and y-axis shift directions SDx and SDy and x-axis and y-axis shift amounts SQx and SQy corresponding to the frame information CI.

In an exemplary embodiment, for example, but without limitation thereto, when the first image data Di1 currently supplied is determined as $20^{th}$ input frame data, the frame data counter 212 may set the frame information CI (refer to FIG. 2) to "20".

Accordingly, the shift determiner 214 may, in accordance with the look-up table LUT, may set the x-axis shift direction SDx and the x-axis shift amount SQx to "left(−)" and "1", respectively, and the y-axis shift direction SDy and the y-axis shift amount SQy to "right(+)" and "1", respectively.

Referring to FIG. 21, the display device may shift image according to the x-axis and y-axis shift directions SDx and SDy and the x-axis and the y-axis shift amounts SQx and SQy.

The first image displayed in the first display area DA1 and the second image displayed in the second display area DA2, respectively, may be shifted according to the look-up table LUT shown in FIG. 20.

That is, according to the input number of the frame data, the display device may shift the first image and the second image in the same direction at the same time.

However, the invention is not limited thereto, and the look-up table that the first image and the second image refer to may be implemented in various manners. Therefore, the x-axis and the y-axis shift directions SDx and SDy and the x-axis and the y-axis shift amounts SQx and SQy may be set differently from each other.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention as set forth in the following claims.

What is claimed is:

1. A display device comprising:

a display panel including a first display area displaying a first image and a second display area adjacent to the first display area and displaying a second image; and an image corrector which generates an image shifted by correcting the first image and the second image, wherein the image corrector corrects the first image by changing a size of a part of the first image and the second image by changing a size of a part of the second image such that the first image is shifted only in the first display area and the second image is shifted only in the second display area.

2. The display device as claimed in claim 1, wherein the first display area is a flat display area.

3. The display device as claimed in claim 1, wherein the second display area is a bent display area positioned on one side of the first display area.

4. The display device as claimed in claim 1, wherein the display panel further comprises a third display area positioned in a direction facing the second display area, the third display area being a bent display area.

5. The display device as claimed in claim 1, wherein the display panel further comprises a fourth display area positioned in a direction which does not face the second display area and a fifth display area positioned in a direction facing the fourth display area.

6. The display device as claimed in claim 1, wherein the image corrector comprises:

a frame data counter which receives a frame data and calculate an input number of the frame data;

a shift determiner which determines a shift direction of the first image and the second image and a shift amount of the first image and the second image according to a pre-stored look-up table;

an area determiner which divides the first display area and the second display area into a plurality of areas, determine a first area among the plurality of areas as a reduction area depending on the determined shift amount and determine a second area among the plurality of areas as an enlargement area; and an image data generator which generates a reduced image corresponding to the determined shift amount and set the reduced image to an image displayed in the first area.

7. The display device as claimed in claim 6, wherein the shift determiner which determines the pre-stored look-up table corresponding to the input number and determine the shift direction and the shift amount using a value included in the pre-stored look-up table.

8. The display device as claimed in claim 6, wherein the shift determiner comprises:

an x-axis shift determiner which determines an x-axis shift direction and an x-axis shift amount of the first image and the second image; and a y-axis shift determiner which determines a y-axis shift direction and a y-axis shift amount of the first image and the second image.

9. The display device as claimed in claim 8, wherein the x-axis shift determiner which determines the x-axis shift amount such that first and second image shift along an x-axis direction in smaller units than a minute image displayed in one pixel.

10. The display device as claimed in claim 8, wherein the y-axis shift determiner which determines the y-axis shift amount such that first and second image shift along a y-axis direction in smaller units than a minute image displayed in one pixel.

11. The display device as claimed in claim 8, wherein the shift determiner which determines the y-axis shift direction and the y-axis shift amount of the first image and the second image after determining the x-axis shift direction and the x-axis shift amount of the first image and the second image.

12. The display device as claimed in claim 6, wherein the shift determiner which determines shift direction of the first image and shift direction of the second image as the same directions.

13. The display device as claimed in claim 6, wherein the area determiner which determines a third area positioned between the first area and the second area, wherein an image displayed in the third area shifts from the enlargement area in a direction to where the reduction area is located.

14. The display device as claimed in claim 6, wherein the image data generator which generates an enlarged image to correspond to the determined shift amount and set the enlarged image to an image displayed in the second display area.

15. The display area as claimed in claim 6, wherein the first image and the second image shift from the enlargement area in a direction to the reduction area.

16. The display device as claimed in claim 1, wherein the first image and the second image prior to shifting have the same size as those of the first image and the second image after shifting.

17. A method for displaying image by a display device including a display panel including a first display area displaying a first image and a second display area adjacent to the first display area and displaying a second image and an image corrector which generates first and second images shifted on the display panel by correcting the first image and the second image, the method comprising:

receiving a frame data including an image data, by the image corrector;

calculating an input number of the frame data and determining a look-up table corresponding to a result of the calculation, by the image corrector;

determining a shift direction and a shift amount of the first image and the second image using the look-up table, by the image corrector;

dividing the first display area and the second display area into a plurality of areas and, depending on the shift amount, determining a first area as a reduction area among the plurality of areas and determining a second area as an enlargement area, by the image corrector;

setting a reduced image to correspond to the shift amount to an image data displayed in the first area, by the image corrector; and setting an enlarged image to correspond to the shift amount to an image data displayed in the second area, by the image corrector, wherein the second display area is a bent display area positioned on one side of the first display area.

18. The method as claimed in claim 17, wherein the shift amount of the first image and the second image is less than a size of minute image displayed in one pixel.

19. The method as claimed in claim 17, wherein the setting to the image displayed in the first area generates the reduced image by reducing an image having a larger area than the first area to an area having a same size as that of the first area and sets the reduced image to an image displayed in the first area, by the image corrector.

20. The method as claimed in claim 17, wherein the setting to the image displayed in the second area generates the enlarged image by enlarging an image having a smaller area than the second area to an area having a same size as that of the second area and sets the enlarged image to an image displayed in the second area, by the image corrector.

* * * * *